US007445139B2

(12) United States Patent
Okouchi

(10) Patent No.: US 7,445,139 B2
(45) Date of Patent: Nov. 4, 2008

(54) POWER DRIVER UTILIZING STORED SPRING ENERGY

(75) Inventor: Yukiyasu Okouchi, Anjo (JP)

(73) Assignee: Makita Corporation, Anjo-Shi (JP)

( * ) Notice: Subject to any disclaimer, the term of this patent is extended or adjusted under 35 U.S.C. 154(b) by 0 days.

(21) Appl. No.: 11/808,087

(22) Filed: Jun. 6, 2007

(65) Prior Publication Data

US 2007/0284406 A1 Dec. 13, 2007

(30) Foreign Application Priority Data

Jun. 12, 2006 (JP) ..... 2006-162885

(51) Int. Cl.
*B25C 1/06* (2006.01)

(52) U.S. Cl. ..... 227/8; 227/132; 227/133; 227/134

(58) Field of Classification Search ..... 227/8, 227/129, 132, 133, 134
See application file for complete search history.

(56) References Cited

U.S. PATENT DOCUMENTS 4,129,240 A * 12/1978 Geist ..... 227/8
4,161,271 A * 7/1979 Bussard ..... 227/8
4,215,808 A * 8/1980 Sollberger et al. ..... 227/146
4,640,452 A * 2/1987 Matt et al. ..... 227/131
4,724,992 A * 2/1988 Ohmori ..... 227/146
4,807,793 A * 2/1989 Ghibely ..... 227/131
4,834,278 A * 5/1989 Lin ..... 227/7
4,953,774 A 9/1990 Lai
4,964,558 A * 10/1990 Crutcher et al. ..... 227/8
5,004,140 A 4/1991 Fushiya et al.
6,604,666 B1 * 8/2003 Pedicini et al. ..... 227/131
6,705,503 B1 * 3/2004 Pedicini et al. ..... 227/131
6,997,367 B2 * 2/2006 Hu ..... 227/132
7,152,774 B2 * 12/2006 Chen ..... 227/131
2003/0188878 A1 10/2003 Paulhus
2006/0091177 A1 * 5/2006 Cannaliato et al. ..... 227/8
2007/0102470 A1 * 5/2007 Miyashita et al. ..... 227/8

FOREIGN PATENT DOCUMENTS

JP A-04-002474 1/1992

* cited by examiner

*Primary Examiner*—Brian D Nash
(74) *Attorney, Agent, or Firm*—Oliff & Berridge PLC

(57) ABSTRACT

It is an object of the invention to provide an effective technique for achieving a smooth driving operation with a driving power tool for driving a driving material into a workpiece. A representative driving power tool for driving a driving material into a workpiece is provided with a coil spring, an operating member. The power tool fixer includes a rotating element that rotates in a normal direction it the spring force of the coil spring as the drive member drives the coil spring, an outer edge of the rotating element, an engaging member and a lock avoiding mechanism. The outer edge includes a first outer edge portion and a second outer edge portion, a first vertical wall and a second vertical wall. The engaging member defines a working stroke of the driving operation. The lock avoiding mechanism avoids the engaging member from being locked to the second vertical wall by the spring force of the coil spring being transmitted to the engaging member via the second vertical wall in the process in which the engaging member moves inward in the radial direction of the rotating element toward the second outer edge portion via the second vertical wall.

5 Claims, 17 Drawing Sheets

POWER DRIVER UTILIZING STORED SPRING ENERGY

BACKGROUND OF THE INVENTION

1. Field of the Invention

The present invention relates to a driving power tool that drives a driving material into a workpiece.

2. Description of the Related Art

Japanese non-examined Patent laid open Publication No. 04-2474 (Japanese patent publication H07-100306) discloses an electric tucker that is powered by a motor and drives a driving material such as a pin into a workpiece. In this electric tucker, a hammer that strikes the driving material is biased by a spring in the striking direction. The hammer is driven to an end position by a driving force of the motor against the spring force of the spring. Thereafter, when the driving force of the motor is shut off in the end position, the hammer strikes the driving material by the spring force of the spring.

In a driving power tool of this type in which same driving operation is continuously repeated, it is necessary to define a working stroke of the driving operation in order to prevent double driving. According to the prior art, a rotating element is locked in a driving standby position by a locking means and after the lock is released and the rotating element is rotated one turn, the rotating element is locked again in the driving standby position. Thus, the working stroke can be defined. In such a construction, it is necessary to achieve a smooth driving operation by reliably performing rotation of the rotating element which is utilized to define the working stroke of the driving operation.

SUMMARY OF THE INVENTION

Accordingly, it is an object of the invention to provide an effective technique for achieving a smooth driving operation with a driving power tool for driving a driving material into a workpiece.

The above-described object can be achieved by a claimed invention. According to the present invention, a representative driving power tool drives a driving material into a workpiece and includes at least a coil spring, an operating member, a drive member, a rotating element, a first outer edge portion, a second outer edge portion, a first vertical wall, a second vertical wall, an engaging member and a lock avoiding mechanism.

The coil spring build up a spring force. The spring force of the compression coil spring is built up by compression of the coil spring and released by free extending movement of the coil spring. The released spring force acts upon the operating member mounted on the end of the spring. The operating member linearly operates by free extension of the coil spring having the built-up spring force and thereby applies a driving force to the driving material. The "driving material" according to the invention may be defined by a pin, nail with and without a head, or a U-shaped staple, etc.

The rotating element rotates in a normal direction against the spring force of the coil spring as the drive member drives the coil spring. Normal direction is defined so as to compress the coil spring. Rotation of the rotating element is interlocked with the movement of the drive member for driving the coil spring. When the drive member is not driven, the biasing force of the coil spring can be applied to the rotating element. Specifically, when the drive member is stopped, the rotating element receives a biasing fore applied in the reverse direction of rotation opposite to the normal direction of rotation by the spring force of the coil spring.

A first outer edge portion is formed in the outer edge of the rotating element and extends in the circumferential direction at a first distance from the center of rotation of the rotating element. Further, a second outer edge portion is formed in the outer edge of the rotating element and extends contiguously to the first outer edge portion in the circumferential direction at a second distance shorter than the first distance.

A first vertical wall is formed between a front end region of the first outer edge portion and a rear end region of the second outer edge portion in the normal direction of rotation of the rotating element. Further, a second vertical wall of this invention is formed between a rear end region of the first outer edge portion and a front end region of the second outer edge portion in the normal direction of rotation of the rotating element.

An engaging member moves outward in the radial direction of the rotating element toward the first outer edge portion via the first vertical wall from the state of engagement with the second outer edge portion, as the rotating element rotates in the normal direction. Then, the engaging member slides on the first outer edge portion and then, moves inward in the radial direction of the rotating element toward the second outer edge portion via the second vertical wall. Then, the engaging member returns back to the state of engagement with the second outer edge portion. In this manner, the engaging member defines a working stroke of the driving operation.

According to the representative driving power tool, the working stroke of the driving operation is defined by cooperation of the rotating element and the engaging member. Typically, the rotating element may comprise a cam disc having at least two different cam diameters, and the engaging member may comprise a rod-like or lever-like member that engages with the cam face as the cam disc rotates. The "working stroke" here represents one working cycle from the start to the completion of the driving The engaging member stops at any given position between the front end region and the rear end region of the second outer edge portion according to the stop timing of the rotating element, when the engaging member moves back into engagement with the second outer edge portion via the first outer edge portion. Therefore, depending on the stop timing of the rotating element, the engaging member may contact in engagement with the rotating element and thus be locked in the process of moving inward in the radial direction of the rotating element from the first outer edge portion to the second outer edge portion.

The lock avoiding mechanism avoids the engaging member from being locked to the second vertical wall by the spring force of the coil spring being transmitted to the engaging member via the second vertical wall in the process in which the engaging member moves inward in the radial direction of the rotating element toward the second outer edge portion via the second vertical wall.

By provision of the lock avoiding mechanism thus constructed, the rotating element is prevented from locking the engaging member and thus, the engaging member is allowed to move downward to the second outer edge portion and can be moved back into engagement with the second outer edge portion.

The lock avoiding mechanism may be provided either on the rotating element side or on the engaging member side. Specifically, the lock avoiding mechanism may be configured to allow relative movement between the rotating element and an input-side member for inputting rotating torque to the rotating element, or to allow relative movement between the rotating elements and the engaging member.

Further, the invention may typically be applied to various tools, such as a nailing machine and a tucker, which drive a driving material into a workpiece by linearly operating the operating member by the spring force of a coil spring.

Other object, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved driving power tools and method for using such driving power tools and devices utilized therein. Representative examples of the present invention, which examples utilized many of these additional features and method steps in conjunction, will now be described in detail with reference to the drawings. This detailed description is merely intended to teach a person skilled in the art further details for pricing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
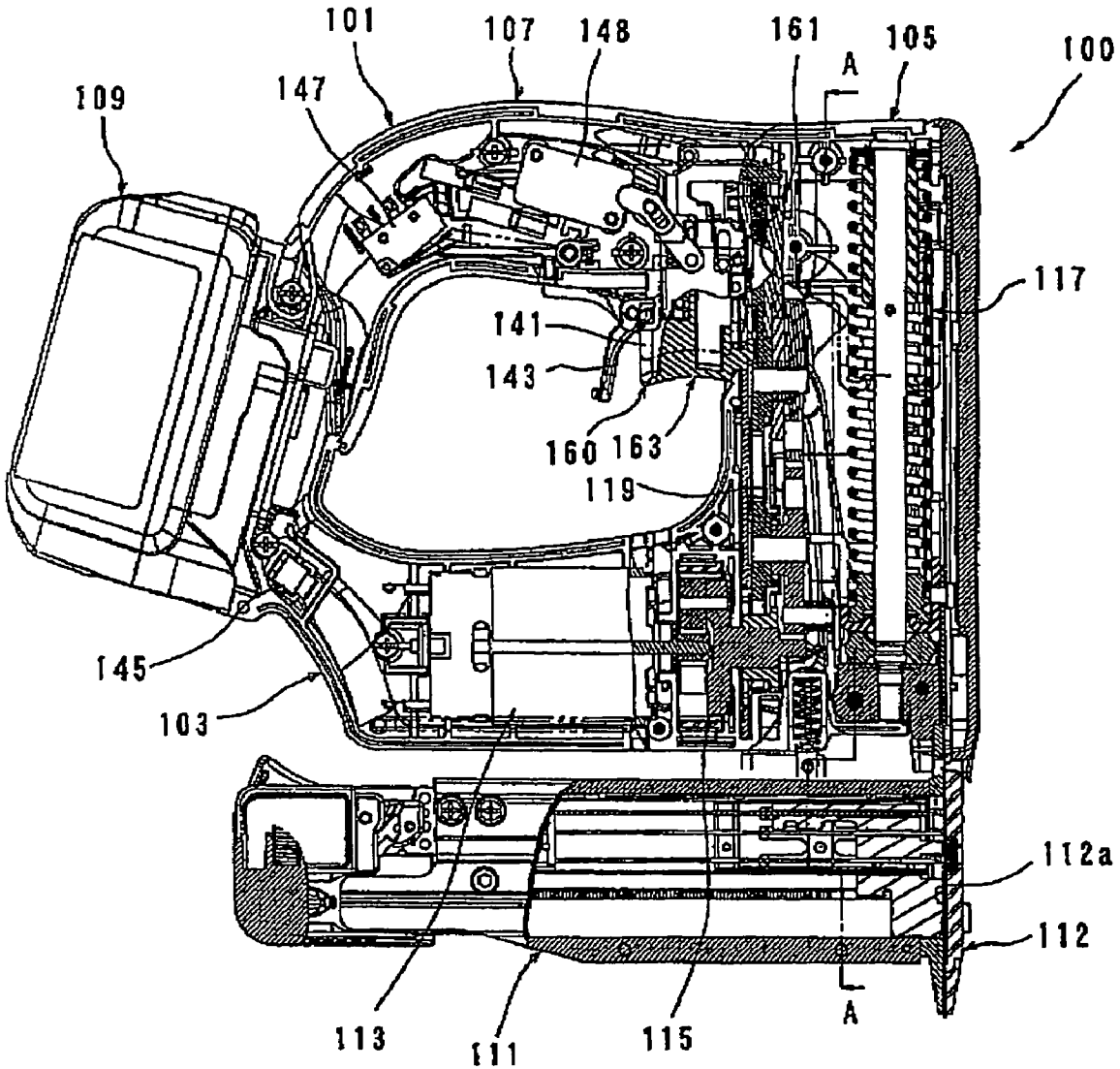
FIG. 1 is a sectional side view, schematically showing an entire battery-powered pin tucker 100 according to an embodiment of the invention.
Figure 2:
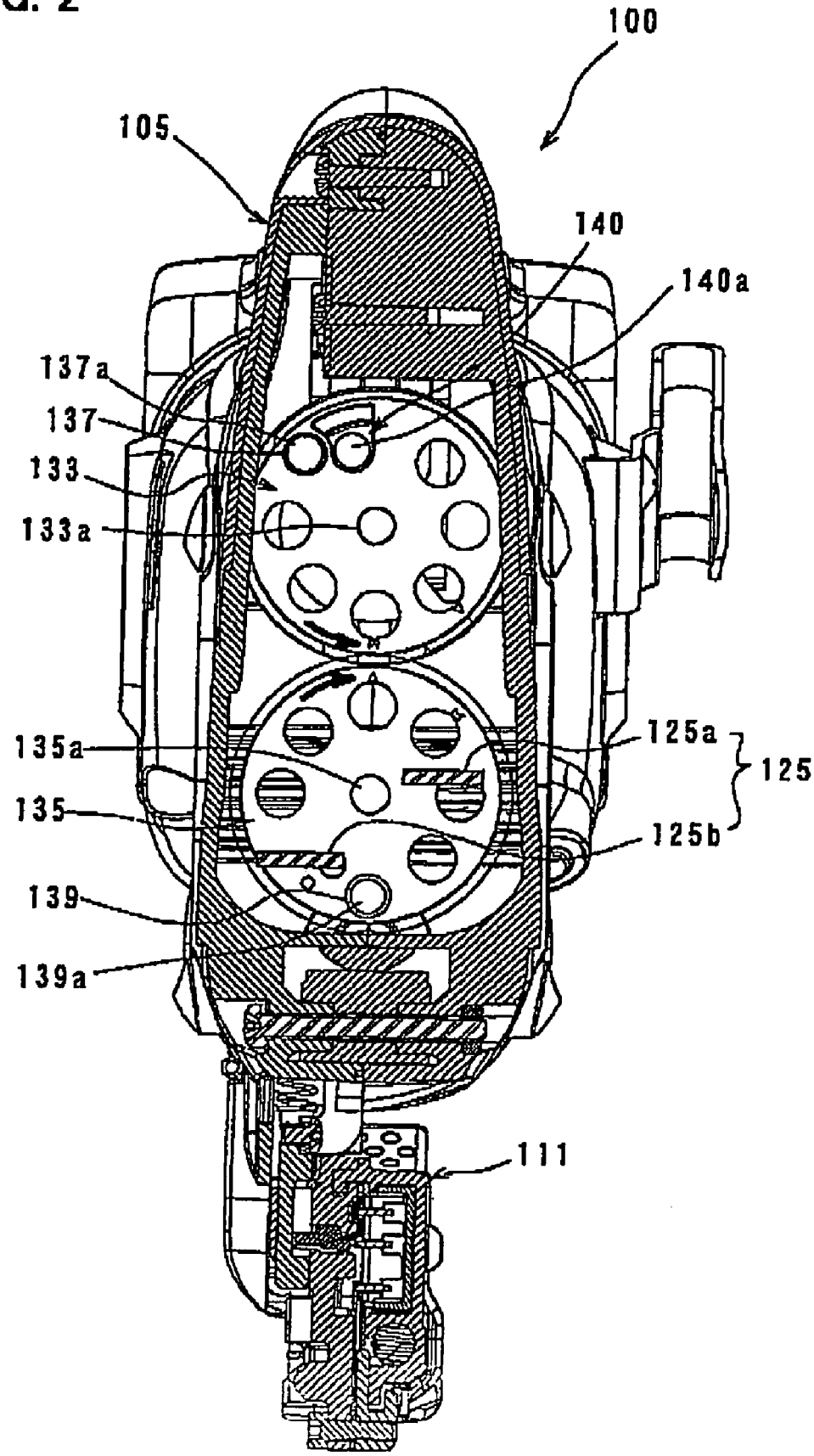
FIG. 2 is a sections view taken along line A-A in FIG. 1, in the state in which a hammer 125 is at the bottom dead center.
Figure 3:
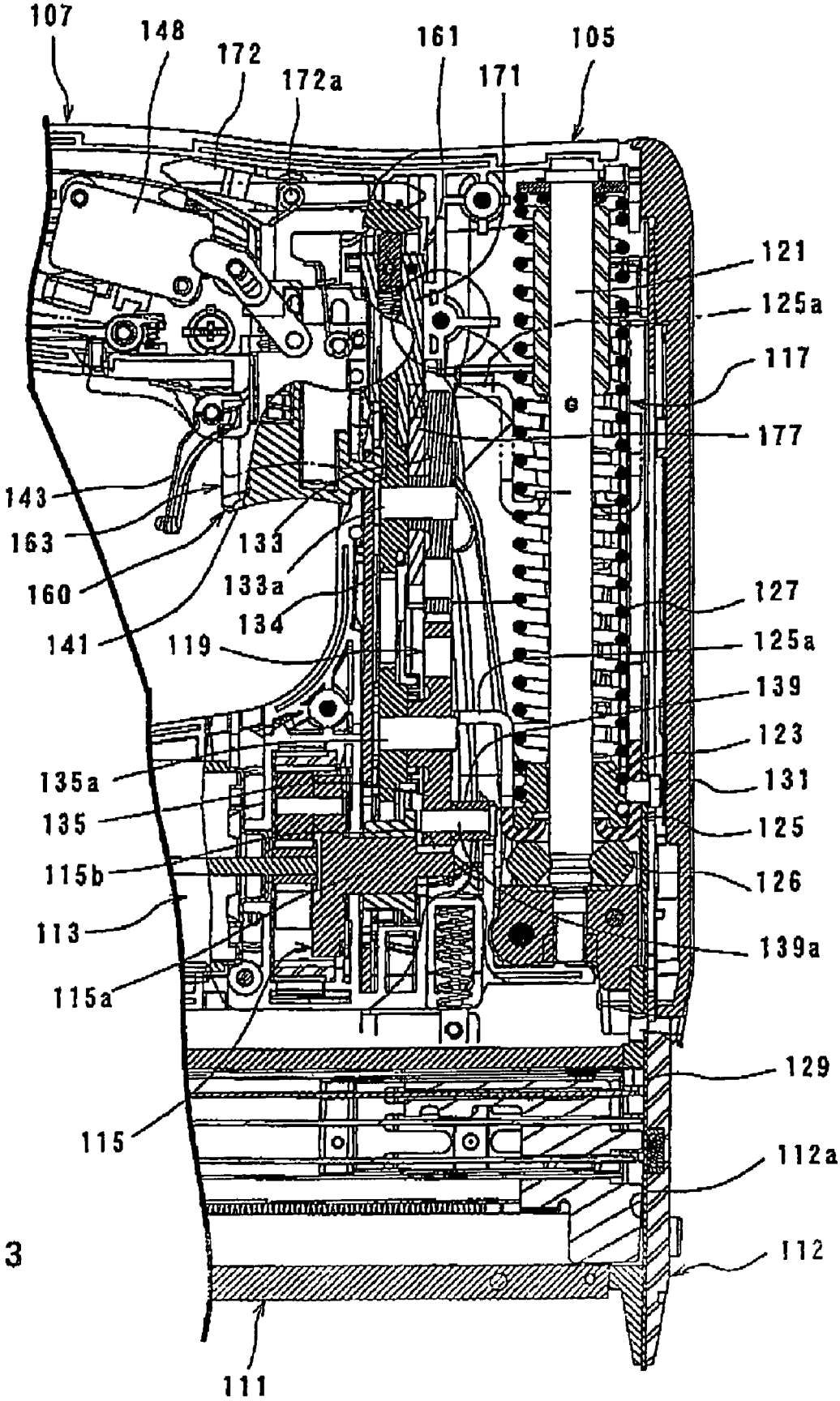
FIG. 3 is an enlarged sectional view of main part of the pin tucker 100.

A representative embodiment of the invention will now be described with reference to FIGS. 1 to 15. FIG. 1 is a sectional side view, schematically showing an entire battery-powered pin tucker 100 as a representative example of a driving power tool according to the embodiment of the present invention. FIG. 2 is a sectional view taken along line A-A in FIG. 1. FIG. 3 is an enlarged sectional view of an essential part of the pin tucker 100.

As shown in FIG. 1, the representative pin tucker 100 includes a body 101, a battery case 109 at houses a battery, and a magazine 111 that is loaded with driving materials in the form of pins to be driven into a workpiece.

The body 101 includes a motor housing 103 that houses a driving motor 113, a gear housing 105 that houses a driving mechanism 117 and a hammer drive mechanism 119, and a handgrip 107 that is held by a user.

In this embodiment, the handgrip 107 is disposed above the motor housing 103. The gear housing 105 is disposed on one lateral end (on the right side as viewed in FIG. 1) of the motor housing 103 and the handgrip 107, and the battery case 109 is disposed on the other lateral end thereof. The magazine 111 is designed to feed pins to be driven to the lower end of the gear housing 105 or to a pin injection part 112 connected to the end of the body 101.

As shown in FIG. 3, the driving mechanism 117 includes a rod-like slide guide 121, a hammer 125, a compression coil spring 127 and a driver 129. The slide guide 121 vertically linearly extends and its upper and lower ends are secured to the gear housing 105. The hammer 125 is vertically movably fitted onto the slide guide 121 via a cylindrical slider 123. The compression coil spring 127 exerts a spring force on the hammer 125 to cause downward driving movement of the hammer 125. The driver 129 is moved together with the hammer 125 and applies a striking force to a pin fed to a pin driving port 112*a* of the injection part 112. The driver 129 is connected to the hammer 125 by a connecting pin 131. Further, the hammer 125 has upper and lower engagement projections 125*a*, 125*b* that are lifted up by engagement with upper and lower lift rollers 137, 139. The pin and the workpiece are not shown in the drawings.

The compression coil spring 127 in this embodiment is configured to build up the spring force by compression and release the built-up spring force by freely extending. The compression coil spring 127 is a feature that corresponds to the "coil spring that can build up a spring force" according to this invention. The hammer 125 and the driver 129 in this embodiment linearly operates by free extension of the compression coil sing 127 having the built-up spring force and forms the "operating member" according to this invention.

The driver 129 is connected to the hammer 125 by the connecting pin 131. Further, the hammer 125 has an upper engagement projection (the engagement projection 125*a* shown in FIGS. 2 and 3) and a lower engagement projection (the engagement projection 125*b* shown in FIG. 2). The upper engagement projection 125*a* is lifted up by engagement with an upper lift roller (the lift roller 137 shown in FIG. 2). The lower engagement projection 125*b* is lifted up by engagement with a lower lift roller (the lift roller 139 shown in FIGS. 2 and 3). The pin as a driving material comprises a straight rod-like material having a pointed end with or without a bead.

Further, in this embodiment, a safety lever 143 for disabling the depressing operation of the trigger 141 is provided on the handgrip 107. The depressing operation of the trigger 141 is disabled when the safety lever 143 is placed in a locked position shown by a solid line in FIG. 1, while the depressing operation is enabled when the safety lever 143 is placed in a lock released position shown by a phantom line in FIG. 1. Further, a light 145 (see FIG. 1) for illuminating a pin driving region is provided on the body 101. When the safety lever 143 is placed in the lock released position, a light illuminating switch 147 is turned on by the safety lever 143 so that the light 145 illuminate. On the other hand, when the safety lever 143 is placed in the locked position, the switch 147 is turned off so that the light 145 goes out.

The rotating output of the driving motor 113 is transmitted as rotation to the hammer drive mechanism 119 via a planetary-gear type speed reducing mechanism 115. The driving motor 113 and the hammer drive mechanism 119 has a function of building up a spring force on the compression coil spring 127 by driving the compression coil spring 127 and form the "drive member" according to this invention. As shown in FIGS. 2 and 3, the hammer drive mechanism 119 includes upper and lower gears 133, 135 that rotate in opposite directions in a vertical plane in engagement with each other, and the upper and lower lift rollers 137, 139 (see FIG. 2) that lift up the hammer 125 by rotation of the gears 133, 135.

The gears 133, 135 are rotatably mounted on a frame 134 disposed within the gear housing 105, via shaft 33*a*, 135*a*. The flit rollers 137, 139 are rotatably mounted to the gears 133, 135 via support shafts 137*a*, 139*a* in a position displaced from the center of rotation of the gears 133, 135. When the gears 133, 135 rotate, the lift rollers 137, 139 revolve around the center of rotation of the gears 133, 135 along an arc. The amount of displacement of the support shaft 137*a* of the upper lift roller 137 is equal to the amount of displacement of the support shaft 139*a* of the lower lift roller 139. The lower gear 135 engages with a driving gear 115*b* formed on an output shaft 115*a* of the speed reducing mechanism 115 and is rotated in a predetermined reduction gear ratio. The gear ratio of the lower gear 135 to the upper gear 133 stands at one to one. Further, the upper and lower lift rollers 137, 139 are disposed with a phase difference of approximately 180°. The lift rollers 137, 139 are in the remotest position from each other, or in which the lower lift roller 139 is located on the lower side of the lower gear 135 and the upper lift roller 137 is located on the upper side of the upper gear 133.

When the driving motor 113 is energized and the upper and lower gears 133, 135 are caused to rotate in the direction of the arrow shown in FIG. 2, the lower lift roller 139 engages from below with the lower engagement projection 125*b* of the hammer 125 located at the bottom dead center (the driving end position) shown in FIG. 2 and moves upward along an arc, and thereby lifts up the hammer 125 by vertical components of the circular arc movement. When the amount of lift of the hammer 125 by the lower lift roller 139 reaches near the maximum, the upper lift roller 137 in turn engages from below with the upper engagement projection 125*a* of the hammer 125 and moves upward along an arc, and thereby lifts up the hammer 125.

Figure 4:
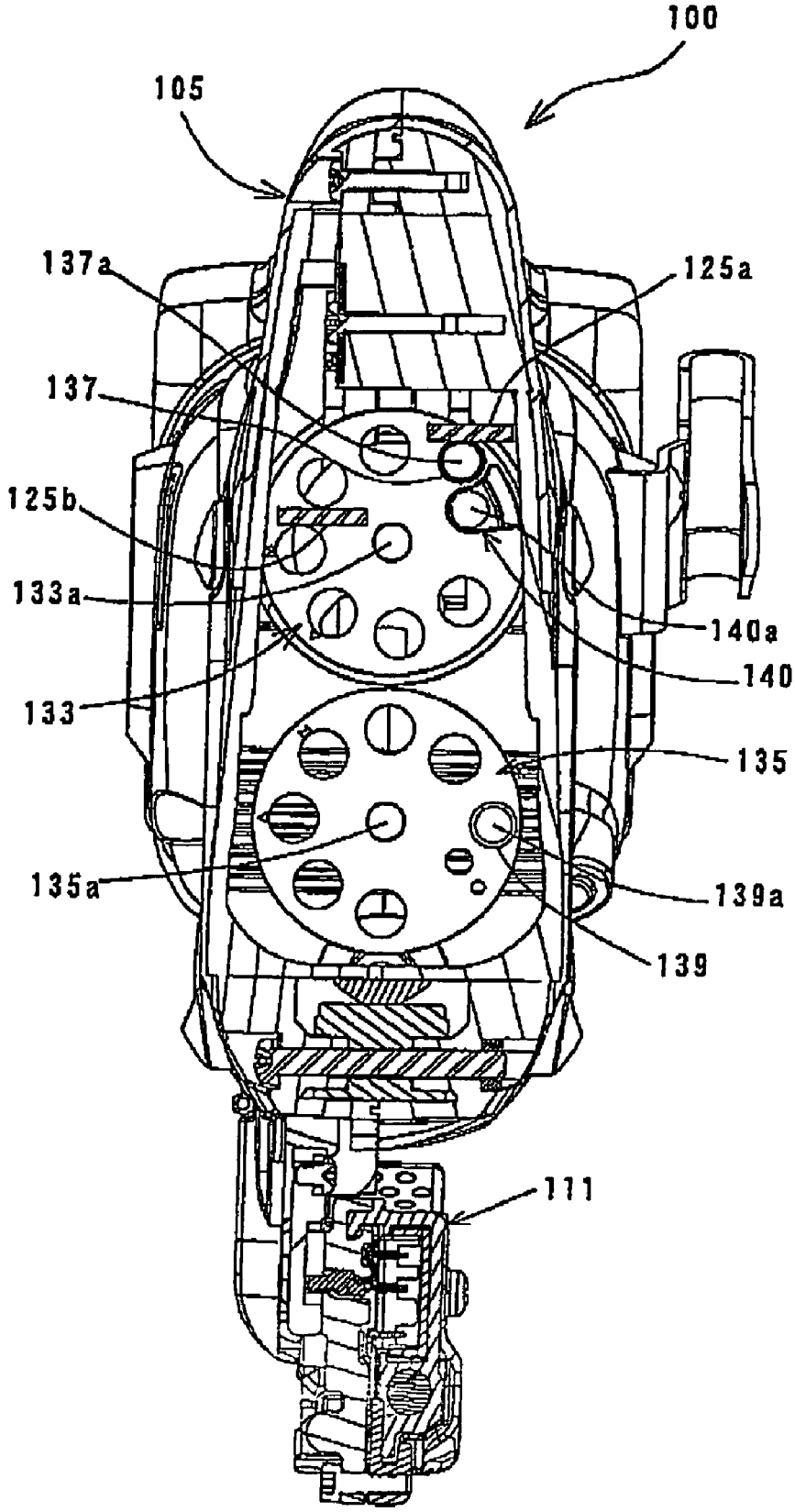
FIG. 4 is a sectional view taken along line A-A in FIG. 1, in the state in which the hammer 125 is in a driving standby position.

Thus, the hammer 125 is moved upward from the bottom dead center toward the top dead center via the relay of the upper and lower lift rollers 137, 139. The compression coil spring 127 is compressed by this upward movement of the hammer 125 and builds up the spring force. Specifically, the hammer 125 is stopped and held in a driving standby position as shown in FIG. 4. Thereafter, when the trigger 141 is depressed, the upper engagement projection 125*a* of the hammer 125 is further passed over in the region of the top dead center from the upper lift roller 137 to a cam 140 which is supported by a support shaft 140*a*. When the driver 129 is lifted upward together with the hammer 125, a pin in the magazine 111 is fed to the pin injection port 112*a* of the injection part 112. Thereafter, upon disengagement from the cam 140, the hammer 125 is caused to perform a downward driving movement by the spring force of the compression coil spring 127. Thus, the pin fed to the pin injection port 112*a* of the injection part 112 is driven into the workpiece by the driver 129 moving downward through the pin injection port 112*a*. After completion of the driving movement, the hammer 125 is held at the bottom dead center by contact with a stopper 126.

Figure 5:
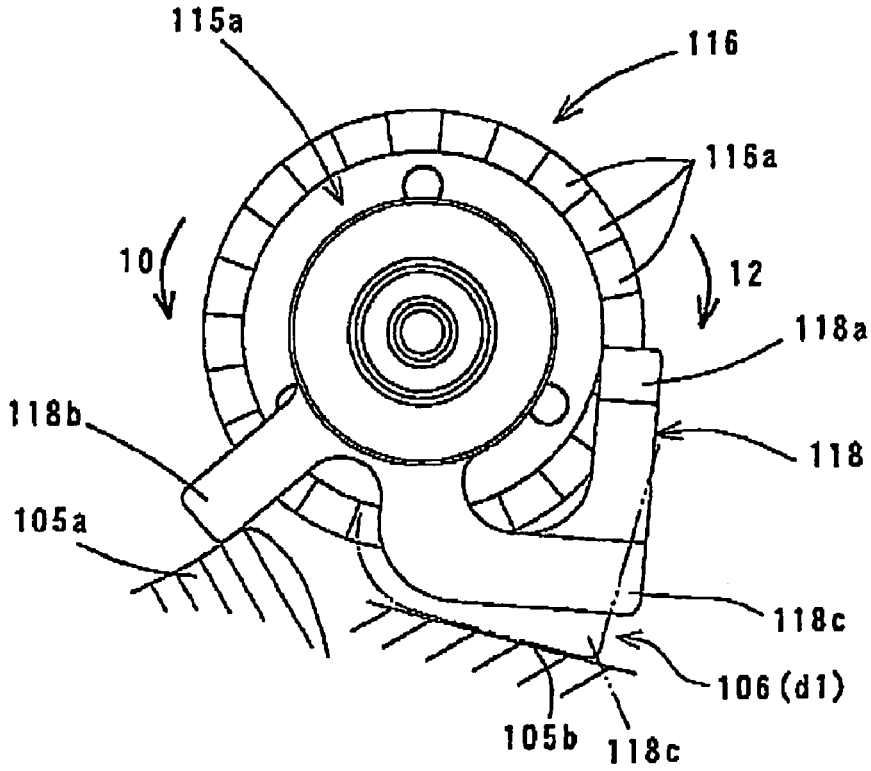
FIG. 5 shows a ratchet wheel 116 and a leaf spring 118 forming a reverse rotation preventing mechanism of a speed reducing mechanism 115 in this embodiment, as viewed from the side of a driving mechanism 117 in FIG. 3.
Figure 6:
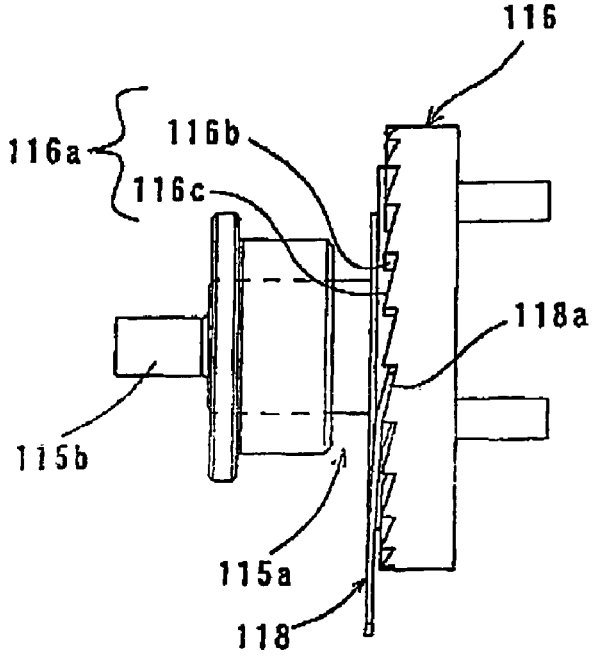
FIG. 6 is a side view of the ratchet wheel 116 and the leaf spring 118 shown in FIG. 5.

The speed reducing mechanism 115 includes a "reverse rotation preventing mechanism" that prevents reverse rotation in a direction opposite to the direction of rotation (normal rotation) caused when the motor 113 is drive The reverse rotation preventing mechanism of the speed reducing mechanism 115 is shown in FIGS. 5 and 6. FIG. 5 shows a ratchet wheel 116 and a leaf spring 118 which form the reverse rotation preventing mechanism of the speed reducing mechanism 115 in this embodiment as viewed from the side of the driving mechanism 117 in FIG. 3. FIG. 6 is a side view of the ratchet wheel 116 and the leaf spring 118 shown in FIG. 5.

As shown in FIGS. 5 and 6, the ratchet wheel 116 has a disc-like shape and is mounted on the output shaft 115*a* of the speed reducing mechanism 115. A plurality of engagement grooves 116*a* are provided in the circumferential region (the ratchet face on the outer circumferential portion) of the ratchet wheel 116. Each of the engagement grooves 116*a* includes a vertical wall 116*b* extending laterally as viewed in FIG. 6 and an inclined wall 116*c* extending obliquely from the bottom of the vertical wall 116*b*. Further, a leaf spring 118 is provided to face the ratchet face of the ratchet wheel 116 and is allowed to rotate on the output shaft 115*a* with respect to the ratchet wheel 116. The leaf spring 118 includes an engagement claw 118*a*, a first contact piece 118*b* and a second contact piece 118*c* on the outer edge portion. The engagement claw 118*a* is configured to extend along the inclined wall 116*c* of the engagement groove 116*a* of the ratchet wheel 116 and can press and engage with the engagement groove 116*a*. In engagement with the engagement groove 116*a*, when the driving motor 113 is driven, the engagement claw 118*a* allows the ratchet wheel 116 to rotate in the direction of an arrow 10 in FIG. 5 (in the normal or forward direction) with respect to the leaf spring 118 and prevents the ratchet wheel 116 to rotate in the direction of an arrow 12 in FIG. 5 (in the reverse direction) with respect to the leaf spring 118.

Specifically, when the ratchet wheel 116 rotates in the normal direction, the inclined wall 116*c* of each of the engagement grooves 116*a* slides with respect to the engagement claw 118*a* and the engagement claw 118*a* comes into engagement with the engagement grooves 116*a* one after another along the circumferential region of the ratchet wheel 116. Thus, the ratchet wheel 116 is allowed to rotate in the normal direction. On the other hand, when the ratchet wheel 116 rotates in the reverse direction, the engagement claw 118*a* butts against the vertical wall 116*b* of any predetermined one of the engagement grooves 116*a*. Thus, the engagement claw 118*a* is locked in the engagement groove 116*a* and held in the locked state. As a result, the ratchet wheel 116 is prevented from rotating in the reverse direction.

In the construction shown in FIG. 5, the center of rotation of the leaf spring 118 coincides with the center of rotation of the ratchet wheel 116. In this invention, however, the centers of rotation of the leaf spring 118 and the ratchet wheel 116 may coincide with each other or may be displaced from each other. Further, in the construction shown in FIG. 5, the plurality of the engagement grooves 116*a* are provided in the circumferential region of the ratchet wheel 116. In this invention, however, engagement grooves corresponding to the engagement grooves 116*a* may be provided on the outer peripheral portion of the ratchet wheel 116 having a circular arc surface, and a member having an engagement claw adapted to the engagement grooves may be used in place of the leaf spring 118.

When the driving motor 113 is driven and the ratchet wheel 116 rotates on the output shaft 115*a* in the normal direction, the leaf spring 118 may be dragged by the ratchet wheel 116 in the same direction and rotated with rotation of the ratchet wheel 116 by the frictional force between the engagement claw 118*a* and the engagement grooves 116*a* (the inclined wall 116*c*) held in engagement with each other. Therefore, in this embodiment, the leaf spring 118 is configured to have the first contact piece 118*b* that can contact a first contact wall 105*a* of the gear housing 105. With this construction, the leaf spring 118 rotates on the output shaft 115*a* in the direction of the arrow 10 in FIG. 5 until the first contact piece 118*b* contacts the first contact wall 105*a* in a first stop position (shown by a solid line in FIG. 5). Thus, further normal rotation of the leaf spring 118 is prevented in the first stop position.

When the ratchet wheel 116 rotates in the reverse direction and the leaf spring 118 rotates in the same direction as the ratchet wheel 116 by the force of engagement between the engagement claw 118*a* and the engagement grooves 116*a*, the second contact piece 118*c* contacts a second contact wall 105*b* of the gear housing 105 in a second stop position (shown by a phantom line in FIG. 5). Thus, further reverse rotation of the leaf spring 118 is prevented in the second stop position.

In other words, the leaf spring 118 is allowed to rotate with a predetermined amount of play (a clearance 106 (d1) in FIG. 5) between the first stop position in which the first contact piece 118*b* contacts the first contact wall 105*a* and the second stop position in which the second contact piece 118*c* contacts the second contact wall 105*b*. Therefore, although the ratchet wheel 116 is prevented from rotating with respect to the leaf spring 118 in the direction of the arrow 12, the leaf spring 118 itself is allowed to rotate in the reverse direction from the second stop position to the first stop position, which results in the ratchet wheel 116 being allowed to rotate in the reverse direction together with the leaf spring 118.

Figure 7:
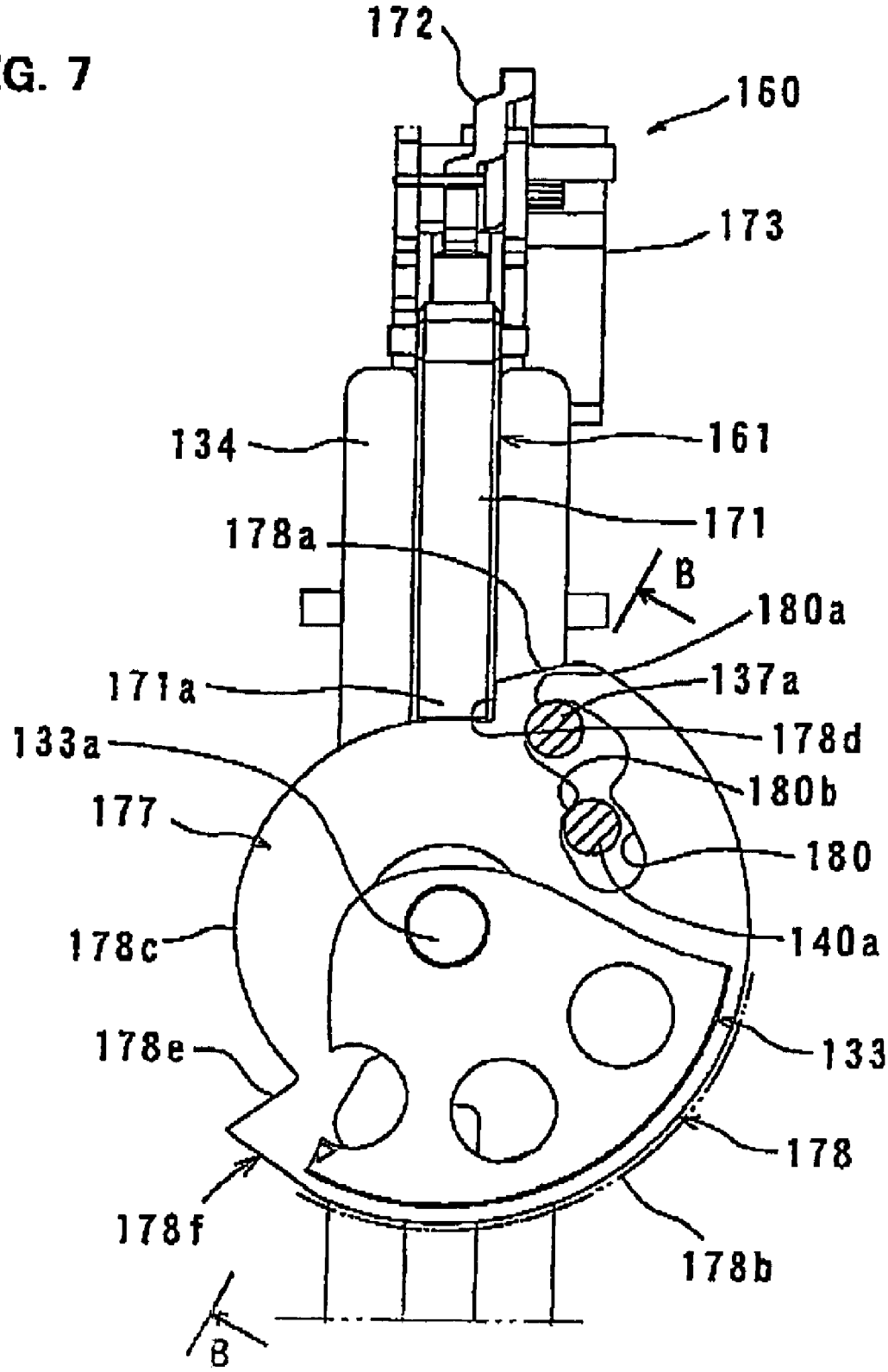
FIG. 7 shows an operating device 160 for controlling energization and de-energization of a driving motor 113 according to this embodiment.
Figure 8:
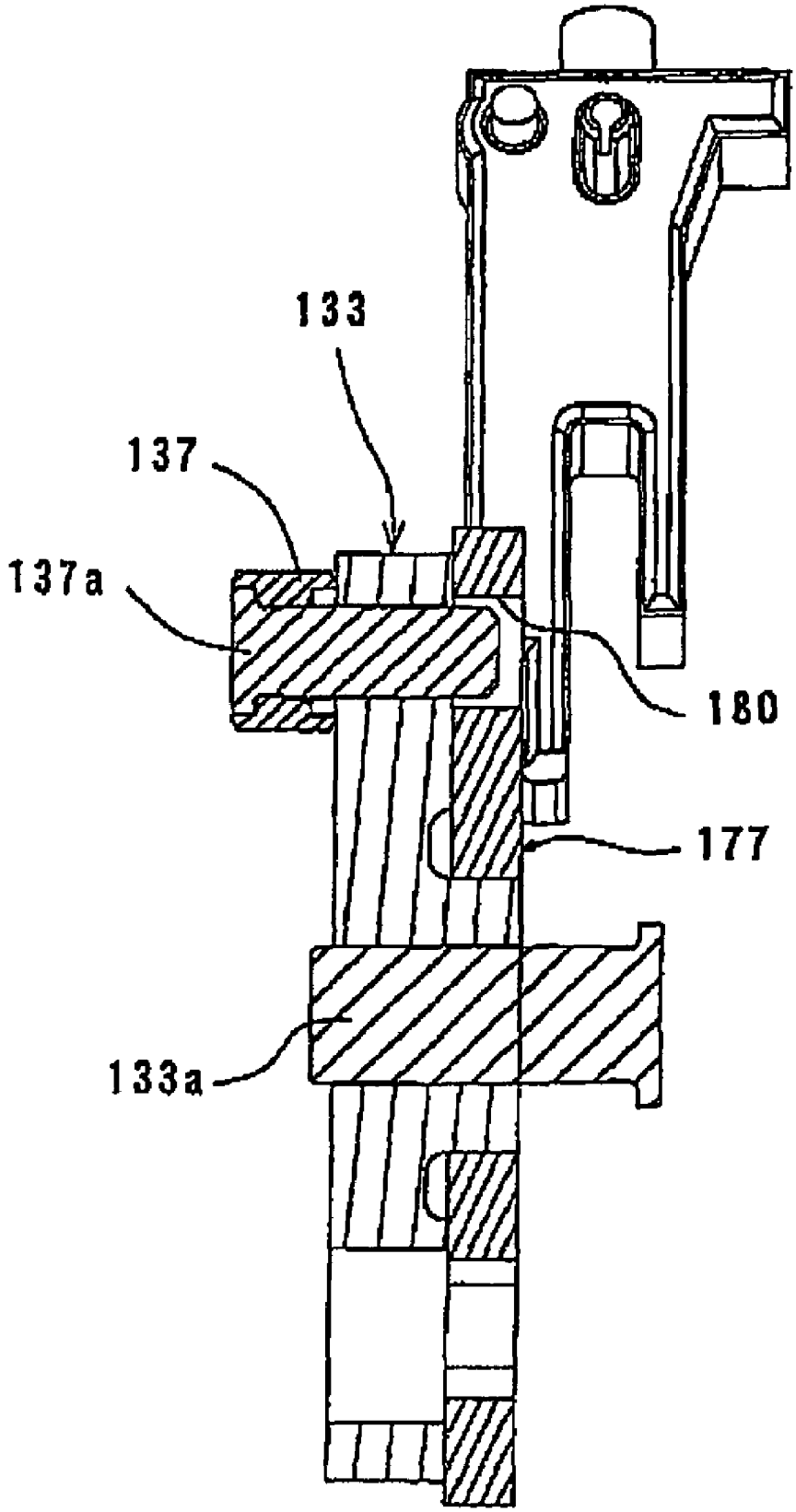
FIG. 8 is a sectional view of an upper gear 133 and a cam disc 177, which is take along line B-B in FIG. 7.

The construction of an operating device 160 for controlling energization and de-energization of the driving motor 113 will now be described with reference to FIGS. 7 and 8. FIG. 7 shows the construction of the operating device 160 for controlling energization and de-energization of the driving motor 113 of this embodiment FIG. 8 is a sectional view of the upper gear 133 and the cam disc 177, which is to along line B-B in FIG. 7.

As shown in FIG. 7, the operating device 160 includes a trigger switch 163 that is turned on by depressing operation of the user, an internal switch 161 that is turned on by interlocking with the depressing operation of the trigger switch 163, and a cam disc 177 that controls a subsequent on-state or off-state of the on-state internal switch 161.

The trigger switch 163 is arranged on the handgrip 107 and includes a trigger 141 that is linearly depressed by the user, a first switch 148 (see FIGS. 1 and 3) and a swing arm (not shown). The first switch 148 is normally biased by a biasing spring (not shown) into the off position to disable the driving motor 113 from being energized. When the trigger 141 is depressed, the first switch 148 is turned to the on position to enable the driving motor 113 to be energized. The swing arm interlocks the depressing operation of the trigger 141 to the internal switch 161.

The internal switch 161 includes a cam block 171 that linearly moves by interlocking with the depressing operation of the trigger 141, a switch arm (a switch arm 172 shown in FIG. 3) that is rotated on a shaft (a shaft 172*a* shown in FIG. 3) by the cam block 171, and a second switch 173 that is turned to the on position to enable the driving motor 113 to be energized when the switch arm is rotated. The cam block 171 is mounted to the frame 134 such that the cam block 171 can linearly move in the same direction as the depressing direction of the trigger 141. The cam block 171 has an elongate (rod-like) shape. The cam block 171 is a feature that corresponds to the "engaging member" according to this invention.

The cam disc 177 is mounted in such a manner as to rotate together with the upper gear 133 of the above described hammer drive mechanism 119 (see FIG. 3). The cam disc 177 is a rotating element that rotates in a normal direction against the spring force of the compression coil spring 127 when the compression coil spring 127 is driven in the direction of compression by the driving motor 113 and the hammer drive mechanism 119. The cam disc 177 is a feature that corresponds to the "rotating element" according to this invention. Therefore, in this embodiment, the direction of rotation of the cam disc 177 that rotates when the compression coil spring 127 is driven in the direction of compression by the driving motor 113 and the hammer drive mechanism 119 is defined as a normal direction (a predetermined direction), and a direction opposite to the normal direction is defined as a reverse direction (a direction opposite to the predetermined direction). The cam disc 177 has an outer peripheral surface designed as a cam face 178 and is disposed such that a contact portion 171*a* of the cam block 171 faces the cam face 178. The cam face 178 of the cam disc 177 includes at least a rake region 178*a*, a large-diameter region 178*b*, a small-diameter region 178*c*, a first vertical wall 178*d*, a second vertical wall 178*e* and a flat surface 178*f*.

The rake region 178*a* formed in the cam face 178 of the cam disc 177 is located between the large-diameter region 178*b* and the small-diameter region 178*c* and comprises an inclined surface extending linearly from the small-diameter region 178*c* to the large-diameter region 178*b*. When the trigger 141 is depressed and the cam block 171 is moved in the throwing direction that turns on the second switch 173, the rake region 178*a* engages with the contact portion 171*a* of the cam block 171. The rake region 178*a* then further moves the cam block 171 in the throwing direction and thereby releases the interlock between the cam block 171 and the trigger 141 side.

The large-diameter region 178*b* and the small-diameter region 178*c* which are formed in the cam face 178 of the cam disc 177 each comprise a surface of a circular arc configuration defined on the axis of rotation of the cam disc 177.

The large-diameter region 178*b* is a region which is relatively distant from the center of rotation of the cam disc 177. The large-diameter region 178*b* moves with respect to the contact portion 171*a* of the cam block 171 while being held in engagement with the contact portion 171*a* and thereby holds the second switch 173 in the on position. The small-diameter region 178*c* is a region which is relatively near from the center of rotation of the cam disc 177. The small-diameter region 178*c* disengages from the contact portion 171*a* of the cam block 171 and allows the second switch 173 to be returned to the off position. Particularly, in this embodiment, as shown in FIG. 7, the angular range of the small-diameter region 178*c* extends over more than 90° of the perimeter of the cam disc 177. The small-diameter region 178*c* is designed to be utilized as a braking or inertial operation region for the driving motor 113 after the second switch 173 is returned to the off position and the driving motor 113 is de-energized. Specifically, the small-diameter region 178*c* has the braking or inertial operation region.

The large-diameter region 178*b* and the small-diameter region 178*c* here correspond to the "first outer edge portion extending in the circumferential direction at a first distance from the center of rotation of the rotating element" and the "second outer edge portion extending contiguously to the first outer edge portion in the circumferential direction at a second distance shorter than the first distance", respectively, according to this invention.

The first vertical wall 178*d* formed in the cam face 178 of the cam disc 177 is designed as a vertical wall formed on the boundary between the small-diameter region 178*c* and the rake region 178*a*. The first vertical wall 178*d* contacts (abuts against) the side surface of the contact portion 171*a* of the cam block 171 and thereby prevents the cam disc 177 from rotating beyond a specified position (overrunning). The driving standby position of the cam disc 177 is the position in which the contact portion 171*a* of the cam block 171 is placed on the end of the small-diameter region 178*c* on the side of the rake region 178*a* or is in contact with or adjacent to the first vertical wall 178*d* while being in engagement with the small diameter region 178*c*. The first vertical wall 178*d* here is a wall-like part extending vertically between the front end region of the large-diameter region 178*b* and the rear end region of the small-diameter region 178*c* with respect to the normal direction of rotation of the cam disc 177 and corresponds to the "first vertical wall" according to this invention.

The second vertical wall 178*e* formed in the cam face 178 of the cam disc 177 is a vertical wall formed on the boundary between the rear end region of the large-diameter region 178*b* and the front end region of the small-diameter region 178*c* with respect to the normal direction of rotation of the cam disc 177 (the counterclockwise direction as viewed in FIG. 7). The second vertical wall 178*e* here corresponds to the "second vertical wall" according to this invention.

The flat surface 178*f* formed in the cam face 178 of the cam disc 177 is provided in the rear end region of the large diameter region 178*b* and typically formed by flattening a circular arc portion of the rear end region. The flat surface 178*f* is shaped such that the distance from the center of rotation of the cam disc 177 to the flat surface 178*f* gradually increases with respect to the reverse direction of rotation of the cam disc 177. The flat surface 178*f* corresponds to the "surface configured such that the distance from the center of rotation of the rotating element to said surface gradually increases" according to this invention. The flat surface 178*f* may be formed either in the process of molding the cam disc 177 or by cutting a predetermined region of a circular arc portion of the cam face 178 of the cam disc 177 into a flat surface in a post-process after the cam disc 177 is once molded.

Further, a through hole 180 is formed through the cam disc 177 in the through-thickness direction. As shown in FIGS. 7 and 8, the trough bole 180 is designed to engage with the support shaft 137*a* of the lift roller 137 provided on the upper gear 133 and with the support shaft 140*a* of the cam 140. Moreover, in order to allow relative rotation between the cam disc 177 and the upper gear 133 on the same axis (the shaft 133*a*) in this state of engagement, the through hole 180 is configured to extend in an elongate manner along the direction of relative rotation of the cam disc 177 and the upper gear 133. The support shafts 137*a*, 140*a* are shaped like a pin and correspond to the "engagement pin" according to this invention, and the through hole 180 that engages with the support shafts 137*a*, 140*a* correspond to the "engagement groove" according to this invention. Further, the through hole 180 has a first locking part 180*a* and a second locking part 180*b* that contact and lock the support shafts 137*a* and 140*a*, respectively, during normal rotation of the cam disc 177. The first and second locking parts 180*a*, 180*b* form the "locking part" according to this invention. The cam disc 177 is thus configured to rotate together with the upper gear 133 in the normal direction of rotation or counterclockwise as viewed in FIG. 7. The upper gear 133 in this case is a feature that corresponds to the "gear that inputs driving torque to the lock avoiding mechanism" according to this invention.

In this embodiment, the through hole 180 is formed by integrally connecting a through hole area for receiving the support shaft 137*a* and a through hole area for receiving the support shaft 140*a*. As an alternative to this construction, the through hole areas for receiving the support shafts 137*a*, 140*a* may be separately formed as individual through holes. Further, in place of the through hole 180, a non-through groove (engagement groove) may be used. The number of engagement grooves and engagement pins and the number of engagement pins to engage in one engagement groove can be appropriately selected as necessary. An equivalent of the through hole 180 may be formed in the upper gear 133 and an engagement pin to engage with this equivalent may be formed on the cam disc 177.

The driving motor 113 is energized when both the motor driving first switch 148 that is directly actuated by the trigger 141 and the motor driving second switch 173 that is actuated by the internal switch 161 interlocked with the depressing operation of the trigger 141 are turned on, while the driving motor 113 is de-energized when either one of the first and second switches 148 and 173 is turned off. When the driving motor 113 is energized, as described above, the hammer drive mechanism 119 is driven via the speed reducing mechanism 115 and lifts up the hammer 125 from the bottom dead center toward the top dead center while compressing the compression coil spring 127 in the spring compressing direction. Then, the hammer 125 is stopped and held in the driving standby position as shown in FIG. 4, and thereafter, when the trigger 141 is depressed, the hammer 125 reaches the top dead center. The hammer 125 is then caused to perform a downward driving movement by the spring force of the compression coil spring 127. In this driving operation by the hammer 125, one working stroke (which is also referred to as "working cycle") is defined by movement of the hammer 125 starting from the driving standby position shown in FIG. 4 and returning back to the driving standby position via the bottom dead center shown in FIG. 2.

Further, when the trigger 141 is depressed and the hammer 125 is caused to perform the first pin driving operation, the second switch 173 that is actuated by the internal switch 161 is turned off even if the trigger 141 is held depressed at the time of completion of the first pin driving operation. In other words, upon completion of the first pin driving operation by the hammer 125, the driving motor 113 is de-energized and the second pin driving operation cannot be subsequently performed even if the trigger 141 is held depressed. Thus, double pin driving can be prevented. Further, when the trigger 141 is released prior to completion of the pin driving operation of the hammer 125 after the driving motor 113 is energized by depressing the trigger 141, the first switch 148 that is directly actuated by the trigger 141 is turned off, so that the driving motor 113 is de-energized and the pin driving operation of the hammer 125 is interrupted.

Figure 9:
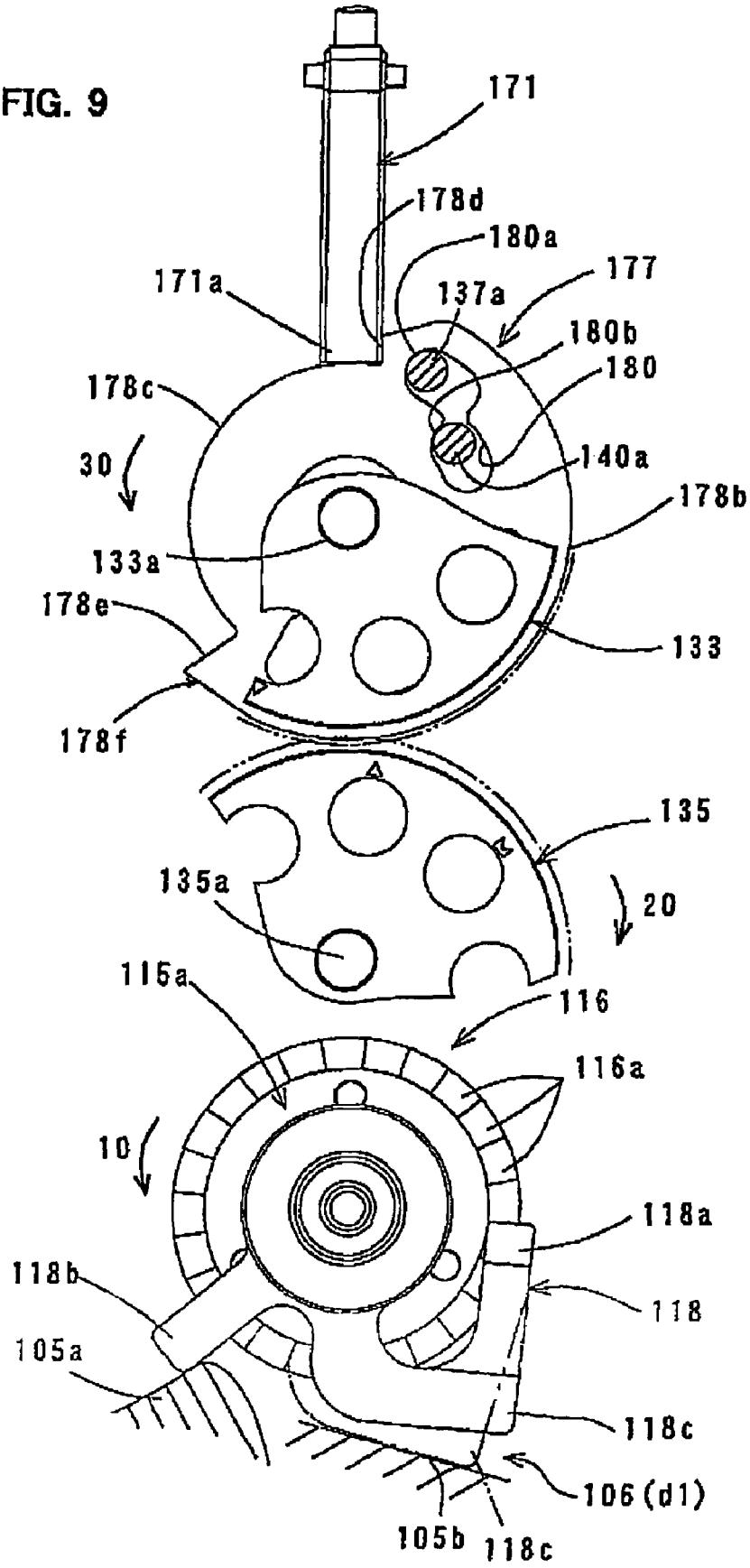
FIG. 9 shows the state in which a contact portion 171*a* of a cam block 171 is in abutting contact with a first vertical wall 178*d* of the cam disc 177 while being held in engagement with a small-diameter region 178*c* after completion of the working stroke of the driving operation.
Figure 10:
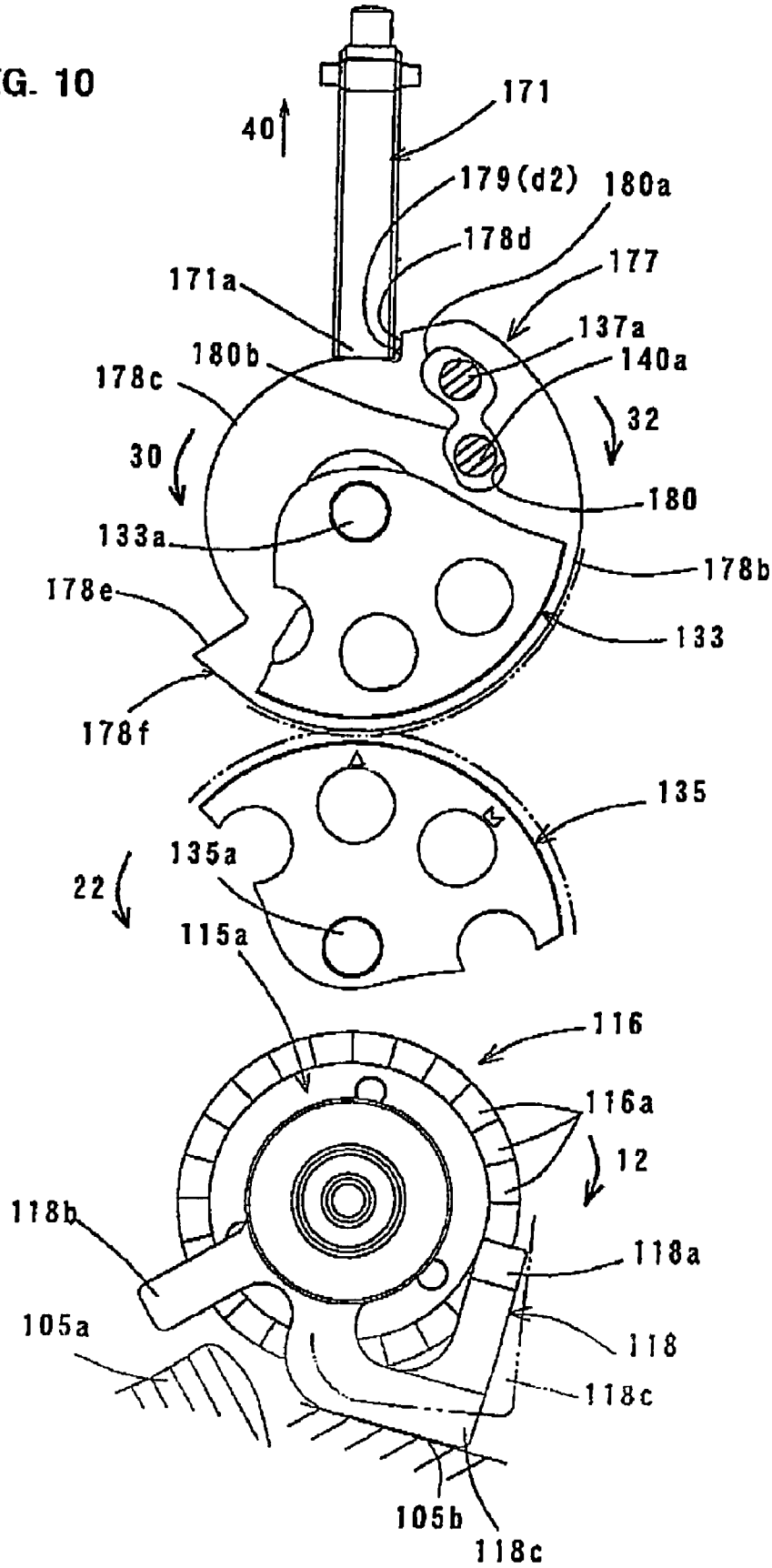
FIG. 10 shows the state in which the contact portion 171*a* of the cam block 171 is disengaged from the first vertical wall 178*d* of the cam disc 177 while being held in engagement with the small-diameter region 178*c*.

Operation of the reverse rotation preventing mechanism of the speed reducing mechanism 115 will now be explained with reference to FIGS. 9 and 10. FIG. 9 shows the state in which the contact portion 171*a* of the cam block 171 is in abutting contact with the first vertical wall 178*d* of the cam disc 177 while being held in engagement with the small-diameter region 178*c* after completion of the working stroke of the driving operation. FIG. 10 shows the state in which the contact portion 171*a* of the cam block 171 is disengaged from the first vertical wall 178*d* of the cam disc 177 while being held in engagement with the small-diameter region 178*c*.

As shown in FIG. 9, immediately after completion of the working stroke of the driving operation, the cam disc 177 is acted upon by inertial force in the normal direction of rotation (in the direction of the arrow 30 in FIG. 9). Thus, the contact portion 171*a* of the cam block 171 is in contact with the first vertical wall 178*d* of the cam disc 177. The inertial force upon the cam disc 177 is transmitted as a rotating force of the output shaft 115*a* in the direction of the arrow 10, a rotating force of the lower gear 135 in the direction of the arrow 20 and a rotating force of the upper gear 133 in the direction of the arrow 30, in this order from the driving motor 113 side. Further, immediately after completion of the working stroke of the driving operation, the engagement claw 118*a* of the leaf spring 118 is in engagement with the engagement groove 116*a* of the ratchet wheel 116, and the first contact piece 118*b* is in contact with the first contact wall 105*a* of the gear housing 105. Thus, the leaf spring 118 is prevented from being dragged by the ratchet wheel 116 in the same direction and rotated with rotation of the ratchet wheel 116.

When the contact portion 171*a* of the cam block 171 is in contact with the first vertical wall 178*d* of the cam disc 177 and also the leaf spring 118 is in engagement with the ratchet wheel 116, the cam block 171 may conceivably be locked. In such a locked state, even if the trigger 141 is depressed, the contact portion 171*a* of the cam block 171 cannot be disengaged from the first vertical wall 178*d*, so that the cam block 171 cannot be raised.

Therefore, even when the contact portion 171*a* of the cam block 171 is in contact with the first vertical wall 178*d* of the cam disc 177 and also the leaf spring 118 is in engagement with the ratchet wheel 116, a predetermined amount of reverse rotation of the ratchet wheel 116 and the leaf spring 118 in engagement with each other is allowed. Specifically, as described above, the leaf spring 118 is allowed to rotate with a predetermined amount of play (the clearance 106 (d1) in FIG. 8) between the first stop position in which the first contact piece 118*b* contacts the first contact wall 105*a* and the second stop position in which the second contact piece 118*c* contacts the second contact wall 105*b*. At this time, the biasing force of the compression coil spring 127 acts upon the ratchet wheel 116 via the speed reducing mechanism 115 in the direction that rotates the ratchet wheel 116 in the reverse direction. Therefore, the ratchet wheel 116 sated upon by the biasing force of the compression coil spring 127 rotates in the reverse direction by a distance corresponding to the amount d1 of the clearance 106, together with the leaf spring 118 with the engagement claw 118*a* held in engagement with the associated engagement groove 116*a*. When the leaf spring 118 rotates on the output shaft 115*a* in the direction of the arrow 12 in FIG. 10 and reaches the second stop position, the second contact piece 118*c* contacts the second contact wall 105*b*. Thus, further reverse rotation is prevented.

In the process in which the ratchet wheel 116 rotates together with the leaf spring 118 in the reverse direction by a distance corresponding to the amount d1 of the clearance 106, the cam disc 177 also rotates in the reverse direction. Thus, as shown in FIG. 10, the contact portion 171*a* of the cam block 171 is displaced a predetermined distance (by an amount d2 of the clearance 179) away from the first vertical wall 178*d* of the cam disc 177, so that the contact between the contact portion 171*a* and the first vertical wall 178*d* is released. Specifically, when the clearance 106 between the second contact piece 118*c* of the leaf spring 118 and the second contact wall 105*b* is gone, the clearance 179 (d2) is created between the contact portion 171*a* of the cam block 171 and the first vertical wall 178*d* of the cam disc 177. The clearance 106 between the second contact piece 118*c* of the leaf spring 118 and the second contact wall 105*b* defines the amount of reverse rotation of the cam disc 177. Further, in the state shown in FIG. 10, the locking of the support shaft 137*a* by the first locking part 180*a* is released, and the locking of the support shaft 140*a* by the second locking part 180*b* is also released.

The rotating force of this reverse rotation of the cam disc 177 is transmitted to the compression coil spring 127, the upper engagement projection 125*a* of the hammer 125 and the Shaft 137*a* of the upper lift roller 137 in this order. With the clearance 179 (d2) created between the contact portion 171*a* of the cam block 171 and the first vertical wall 178*d* of the cam disc 177, contact in engagement between the cam block 171 and the first vertical wall 178*d* can be avoided and the cam block 171 is prevented from being locked. As a result, the depressing operation of the trigger 141 can be smoothly performed.

When the driving operation is started from the state shown in FIG. 10, the movement of the cam block 171 is interlocked with the depressing operation of the trigger 141 (shown in FIG. 3) and thus raised in the direction of an arrow 40 in FIG. 10. The direction of this arrow 40 corresponds to the "outward in the radial direction of the rotating element" according to this invention. As described above, in the process of depressing the trigger 141, the driving motor 113 is energized and the cam disc 177 rotates in the normal direction. Therefore, the contact portion 171*a* of the cam block 177 raised in the direction of the arrow 40 in FIG. 10 moves with respect to the rake region 178*a* in engagement therewith. Then, the contact portion 171*a* goes on the large-diameter region 178*b*, and by further rotation of the cam disc 177 in the normal direction, it moves with respect to the large-diameter region 178*b* in engagement therewith.

Figure 11:
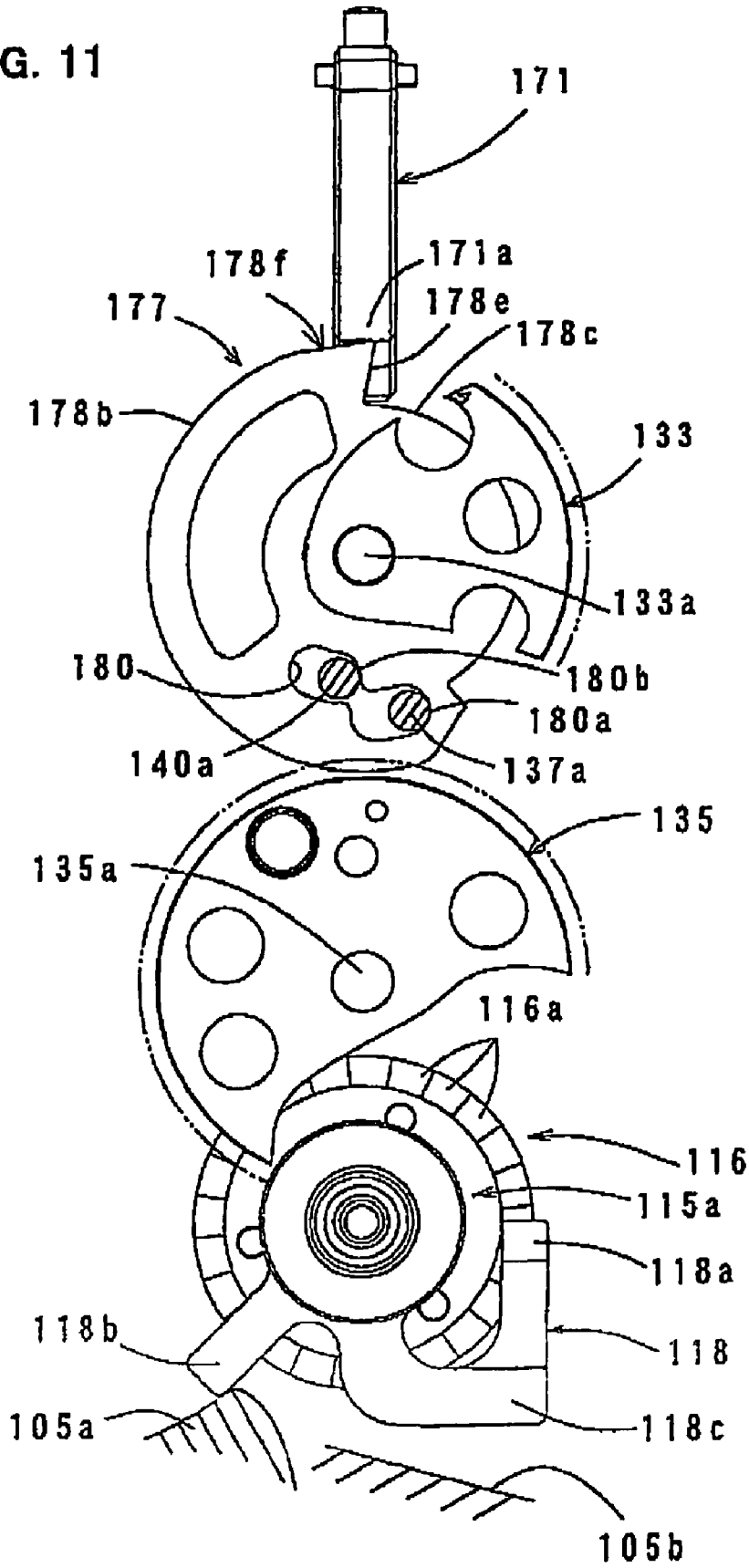
FIG. 11 shows the state in which the contact portion 171*a* of the cam block 177 is in engagement with the large-diameter region 178*b*.
Figure 12:
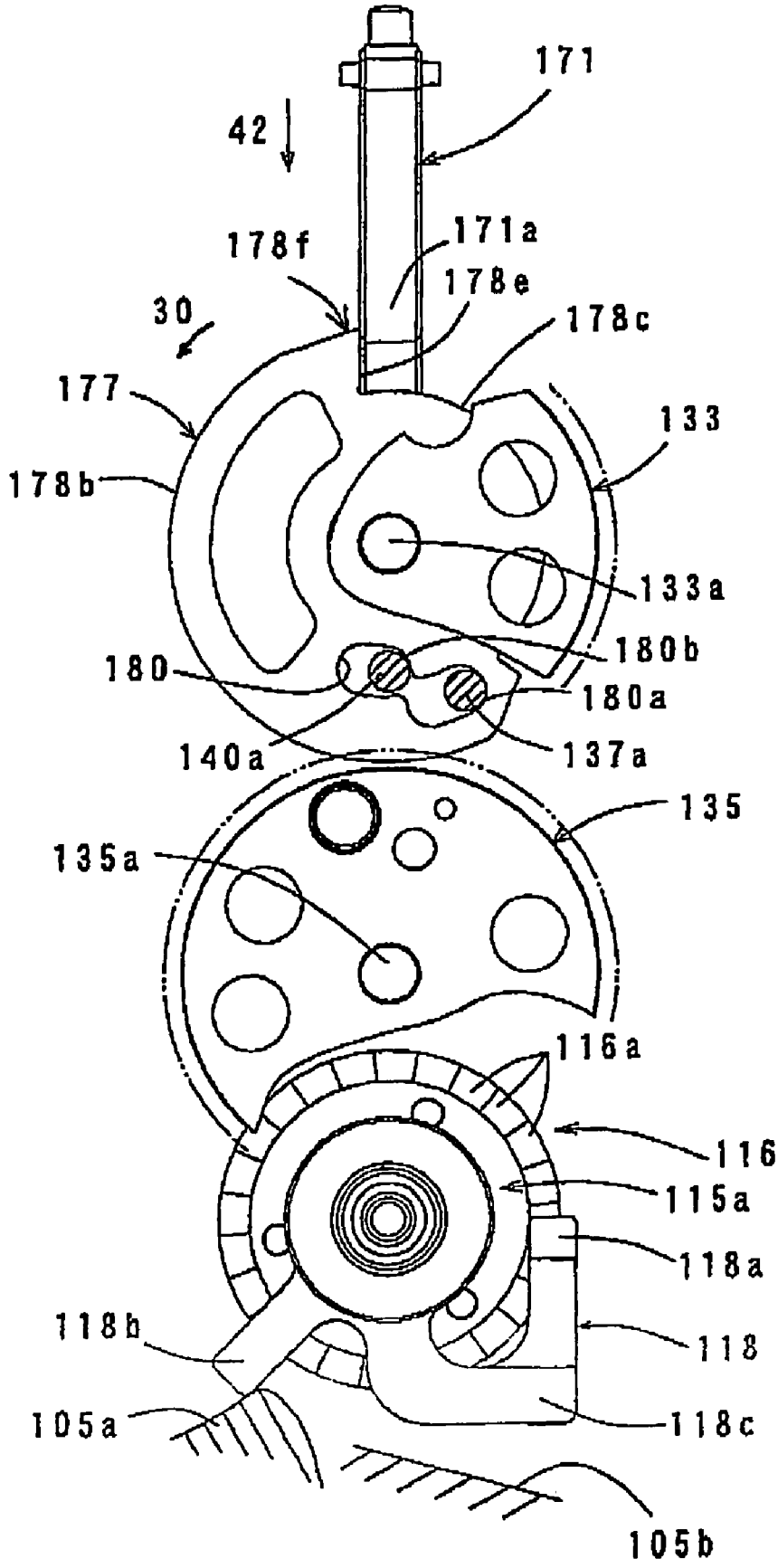
FIG. 12 shows the state in which the contact portion 171*a* of the cam block 177 is on the way from the rear end region of the large-diameter region 178*b* of the cam disc 177 to the small-diameter region 178*c* via the second vertical wall 178*e*.

From this state shown in FIG. 10, by further rotation of the cam disc 177 in the normal direction, as shown in FIG. 11, the contact portion 171*a* of the cam block 177 reaches the rear end region (the flat surface 178*f*) of the large-diameter region 178*b* of the cam disc 177. FIG. 11 shows the state in which the contact portion 171*a* of the cam block 177 is in engagement with the large-diameter region 178*b*. The contact portion 171*a* of the cam block 177 then reaches the small-diameter region 178*c* via the second vertical wall 178*e*. At this time, the cam block 177 moves downward in the direction of an arrow 42 in FIG. 12. As a result, the second switch 173 is returned to the off position and the driving motor 113 is de-energized. FIG. 12 shows the state in which the contact portion 171*a* of the cam block 177 is on the way from the rear end region of the large-diameter region 178*b* of the cam disc 177 to the small-diameter region 178*c* via the second vertical wall 178*e*. The direction of this arrow 42 corresponds to the "inward in the radial direction of the rotating element" according to this invention.

Thereafter, the driving motor 113 continues to rotate by inertia against the spring force of the compression coil spring 127 while being braked and then stops. As a result, the contact portion 171*a* of the cam block 177 moves with respect to the small-diameter region 178*c* in engagement therewith and comes into contact with or near the first vertical wall 178*d* of the cam disc 177 in the driving standby position as shown in FIG. 9 or 10.

Figure 13:
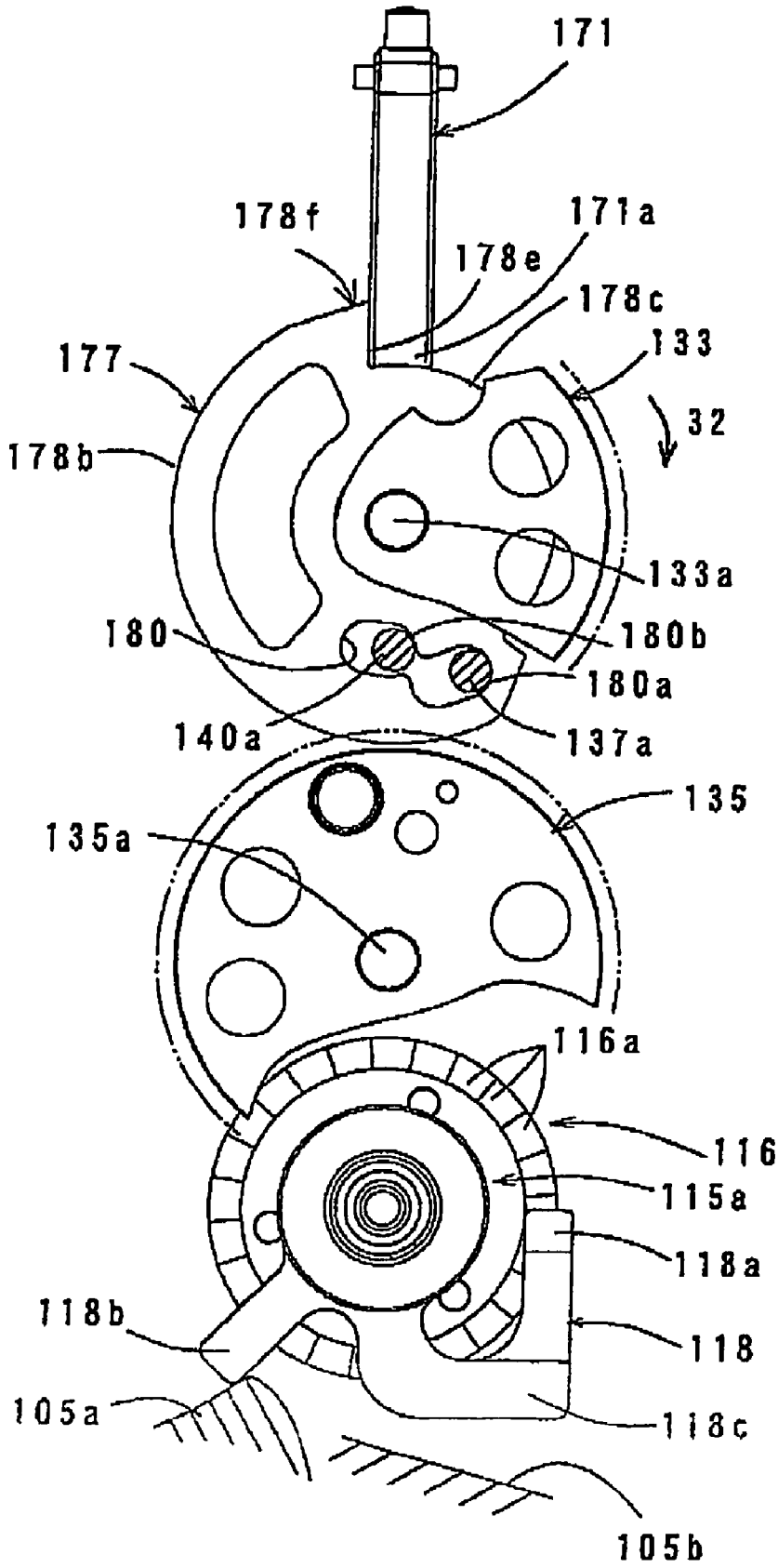
FIG. 13 shows the state in which the contact portion 171*a* of the cam block 177 has reached the small-diameter region 178*c* from the rear end region of the large-diameter region 178*b* of the cam disc 177 via the second vertical wall 178*e*.

Further, depending on the stop timing of the cam disc 177, which will be described below in more detail, the contact portion 171*a* of the cam block 177 comes into contact with or near the second vertical wall 178*e* of the cam disc 177 in engagement with the small-diameter region 178*c* in the driving standby position as shown in FIG. 13. FIG. 13 shows the state in which the contact portion 171*a* of the cam block 177 has reached the small-diameter region 178*c* from the rear end region of the large-diameter region 178*b* of the cam disc 177 via the second vertical wall 178*e*. This driving standby position can be a driving start position where the working stroke of the driving operation begins, or a driving end position where the working stroke of the driving operation ends.

During the operation that the contact portion 171*a* of the cam block 177 moves from the rear end region of the large-diameter region 178*b* of the cam disc 177 to the small-diameter region 178*c* via the second vertical wall 178*e*, when the driving motor 113 is de-energized and rotation of the cam disc 177 in the normal direction is stopped, the cam block 171 may possibly be prevented from moving downward in the direction of the arrow 42 in FIG. 12. Specifically, when rotation of the cam disc 177 in the normal direction is stopped when the cam block 171 and the cam disc 177 are located in the positional relationship shown in FIG. 12, the cam disc 177 rotates in the reverse rotation by the spring force of the compression coil spring 127. As a result, the cam block 171 and the cam disc 177 may possibly be locked against relative movement in engagement with each other. Thus, the cam block 171 cannot move completely down into contact with the small-diameter region 178*c*. Such a locked state may be caused when the time at which the cam block 171 moves radially inward from the large-diameter region 178*b* toward the small-diameter region 178*c* coincides with the time at which the cam disc 177 moves in the reverse direction by the spring force of the compression coil spring 127. In such a locked state, the driving motor 113 is de-energized, and the swing arm (not shown) that serves to interlock the depressing operation of the trigger 141 to the internal switch 161 is not allowed to engage the cam block 171, so that the trigger 141 cannot be depressed.

In order to cope with such problem, the battery-powered pin tucker 100 is provided with the "lock avoiding mechanism". The lock avoiding mechanism has a function of avoiding the cam block 171 from being locked to the second vertical wall 178*e* by the spring force of the compression coil spring 127 being transmitted to the cam block 171 via the second vertical wall 178*e* of the cam disc 177 in the process in which the cam block 171 moves inward in the radial direction of the rotating element toward the small-diameter region 178*c* via the second vertical wall 178*e*. The lock avoiding mechanism comprises the support shaft 137*a* of the lift roller 137, the support shaft 140*a* of the cam 140 and the through hole 180 of the cam disc 177.

With this lock avoiding mechanism, when the driving motor 113 is energized, the driving torque of the upper gear 133 is transmitted to the cam disc 177 via the support shafts 137*a*, 140*a* which are held locked by the first and second locking parts 180*a*, 180*b* within the through hole 180. The driving torque is thus converted into rotation of the cam disc 177 in the normal direction, so that the cam disc 177 rotates together with the upper gear 133 in the normal direction. On the other hand, when the driving motor 113 is de-energized, the transmission of the driving torque of the upper gear 133 to the cam disc 177 is stopped and the locking of the support shafts 137*a*, 140*a* by the associated first and second locking parts 180*a*, 180*b* is released. Thus, the support shafts 137*a*, 140*a* are allowed to move within the through hole 180.

Thus, in the positional relationship of the cam block 171 and the cam disc 177 as shown in FIG. 12, even when rotation of the cam disc 177 in the normal direction is stopped, it is made possible to avoid the cam block 171 from being locked to the second vertical wall 178*e* by the spring force of the compression coil spring 127 being transmitted to the cam block 171 via the second vertical wall 178*e*. Specifically, the cam disc 177 is allowed to rotate in the direction of the arrow 30 in FIG. 12 by provision of the through hole 180 while the upper gear 133 is at a standstill in the state shown in FIG. 12. Therefore, no substantial force of interfering with the movement of the second vertical wall 178*e* of the cam disc 177 and the cam block 171 is caused therebetween. Thus, the second vertical wall 178*e* of the cam disc 177 is prevented from locking the cam block 171 in engagement against movement. Thus, the cam block 171 is allowed to smoothly move downward to the small-diameter region 178*c*. As a result, the state shown in FIG. 13 can be achieved in the positional relationship of the cam block 171 to the cam disc 177.

Figure 14:
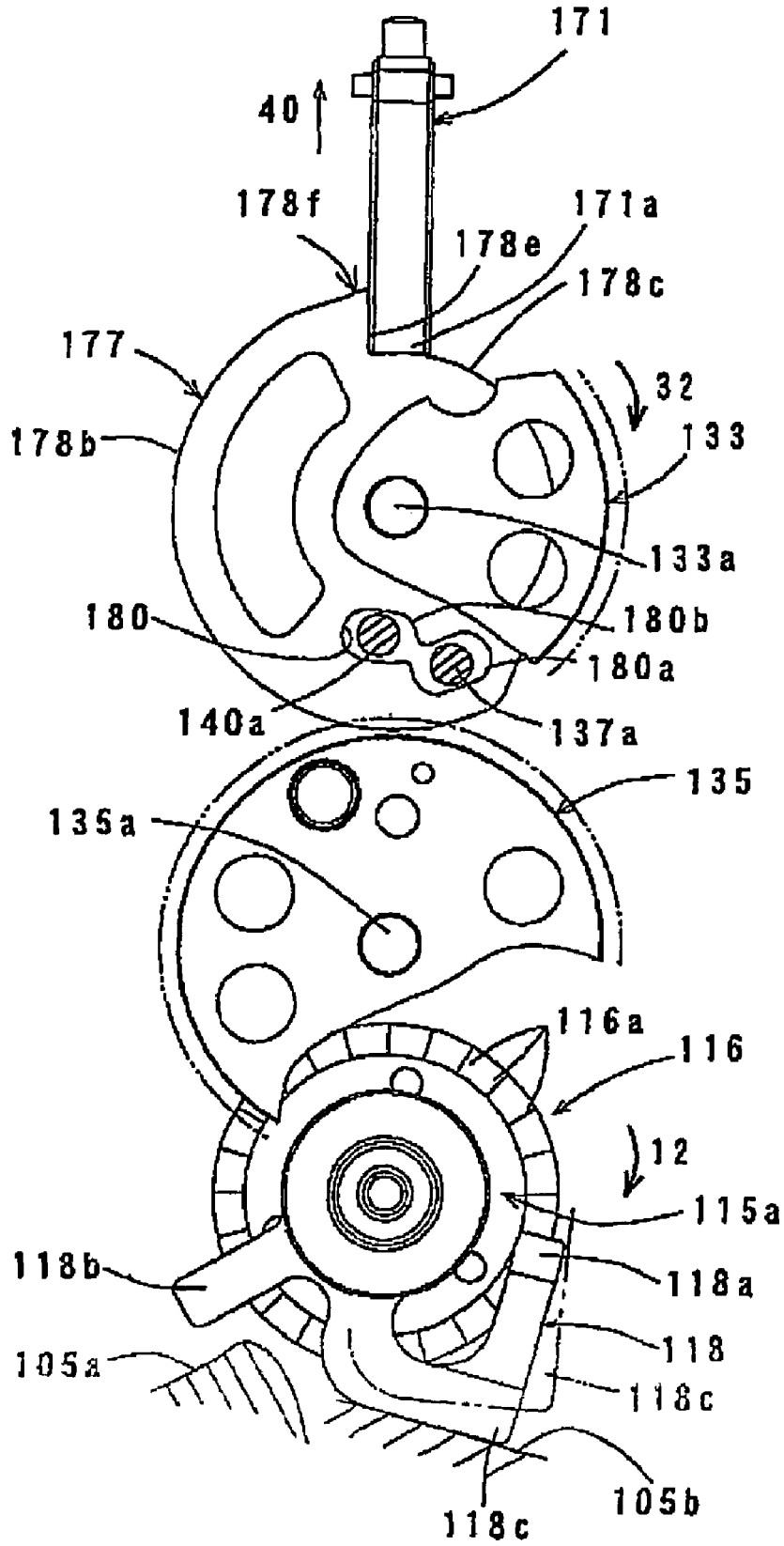
FIG. 14 shows the state in which the reverse rotation preventing mechanism of the speed reducing mechanism 115 is further activated after the state shown in FIG. 13 is realized

Further, in this embodiment, the state shown in FIG. 14 can be subsequently achieved by the action of the reverse rotation preventing mechanism of the speed reducing mechanism 115. FIG. 14 shows the state in which the reverse rotation preventing mechanism of the speed reducing mechanism 115 is further activated after the state shown in FIG. 13 is realized. Specifically, the spring force of the compression coil spring 127 acts upon the ratchet wheel 116 via the speed reducing mechanism 115. Thus, the ratchet wheel 116 rotates on the output shaft 115*a* together with the leaf spring 118 in the reverse direction shown by an arrow 12 in FIG. 14 until the second contact piece 118*c* of the leaf spring 118 contacts the second contact wall 105*b*. In this process of reverse rotation of the ratchet wheel 116, the upper gear 133 also rotates in the reverse direction (in the direction of an arrow 32 in FIG. 14), which causes the support shafts 137*a*, 140*a* to be disengaged from the associated first and second locking parts 180*a*, 180*b* within the through hole 180. Thus, the state shown in FIG. 14 is achieved in which the locking of the support shaft 137*a* by the first locking part 180*a* and the locking of the support shaft 140*a* by the second locking part 180*b* are released. In this state, like in the state shown in FIG. 13, no substantial force of interfering with the movement of the second vertical wall 178*e* of the cam disc 177 and the cam block 171 is caused therebetween.

In the state shown in FIG. 14, the cam block 171 is in engagement with the small-diameter region 178*c* and located in a different driving standby position (second driving standby position) from the driving standby position (first driving standby position) shown in FIG. 9 or 10. Like the first driving standby position shown in FIG. 9 or 10, the second driving standby position shown in FIG. 14 can also be a driving start position where the working stroke of the driving operation begins, or a driving end position where the working stroke of the driving operation ends. Specifically, in this embodiment, the cam block 171 stops at any given position between the front end region (on the second vertical wall 178*e* side) and the rear end region (on the first vertical wall 178*d* side) of the small-diameter region 178*c* according to the stop timing of the cam disc 177. Thus, the driving standby position of the cam block 171 can be formed at any given position between the front end region and the rear end region of the small-diameter region 178*c*.

Further, in the state shown in FIG. 14, the driving motor 113 is de-energized and the trigger 141 can be depressed. Thus, the driving operation can be started from this state. In this case, the movement of the cam block 171 is interlocked with the depressing operation of the trigger 141 and thus raised in the direction of the arrow 40 in FIG. 14. In this process of depressing the trigger 141, the driving motor 113 is energized and the cam disc 177 rotates in the normal direction. Therefore, the contact potion 171*a* of the cam block 177 raised in the direction of the arrow 40 in FIG. 14 moves with respect to the rake region 178*a* in engagement therewith. Then, the contact portion 171*a* goes on the large-diameter region 178*b*, and by further rotation of the cam disc 177 in the normal direction, it moves with respect to the large-diameter region 173*b* in engagement therewith. Subsequently, by further rotation of the cam disc 177 in the normal direction, the contact portion 171*a* of the cam block 177 reaches the rear end region of the large-diameter region 178*b* of the cam disc 177 and then the small-diameter region 178*c* via the second vertical wall 178*e*.

Figure 15:
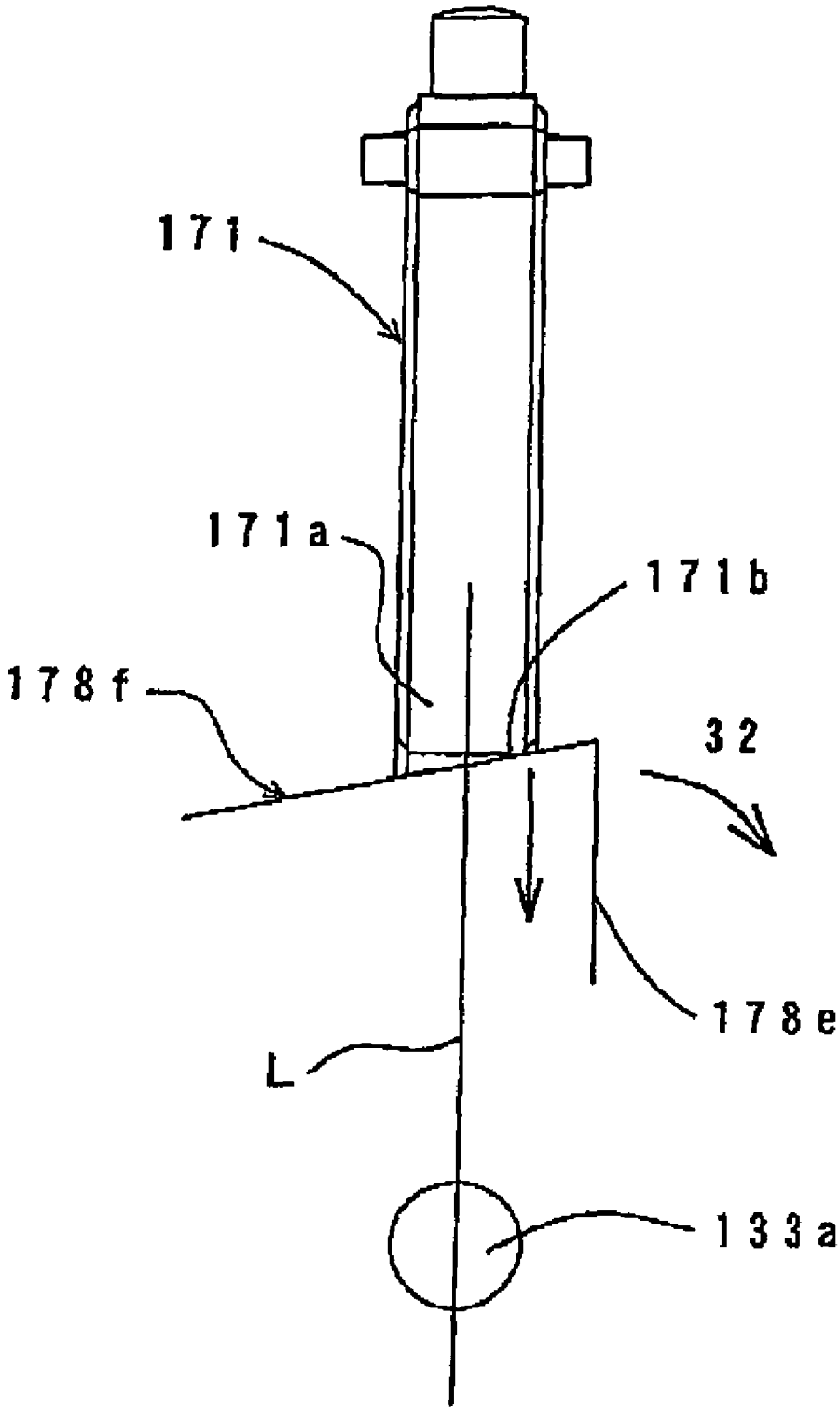
FIG. 15 shows the contact portion 171*a* of the cam block 177 sliding on the flat surface 178*f* formed in the rear end region of the large-diameter region 178*b* of the cam disc 177.

FIG. 15 is referred to with regard to the movement of the cam block 171 which has reached the rear end region (the flat surface 178*f*) of the large-diameter region 178*b* of the cam disc 177 during normal rotation of the cam disc 177. FIG. 15 shows the contact portion 171*a* of the cam block 177 sliding on the flat surface 178*f* formed in the rear end region of the large-diameter region 178*b* of the cam disc 177.

As shown in FIG. 15, the flat surface 178*f* is shaped such that the distance from the center of rotation of the cam disc 177 to the flat surface 178*f* gradually increases with respect to the reverse direction of rotation of the cam disc 177. Moreover, the configuration of the flat surface 178*f* is designed to create a moment in the direction of an arrow 32 in FIG. 15 on the cam disc 177 by a downward pressing force of the cam block 171 pressing the flat surface 178*f*. Thus, the downward pressing force that acts upon the flat surface 178*f* via an engagement portion 171*b* of the cam block 171 is converted into the force of rotation of the cam disc 177 in the reverse direction (in the direction of the arrow 32 in FIG. 15). In other words, the flat surface 178*f* has a function of converting the downward pressing force acting upon the flat surface 178*f* via the cam block 171, into the force of rotation of the cam disc 177 in the reverse direction (in the direction of the arrow 32 in FIG. 15). Further, it is only essential for the surface formed in the rear end region of the cam face 178 of the cam disc 177 to be shaped such that the distance from the center of rotation of the cam disc 177 to the surface gradually increases with respect to the reverse direction of rotation of the cam disc 177. A curved surface may be applied in place of the flat surface 178*f*. Further, the configuration designed to create a moment in the direction of the arrow 32 in FIG, 15 on the cam disc 177 may be provided on the cam block 171 side.

With this construction, during rotation of the cam disc 177 together with the upper gear 133 in the normal direction, the support shafts 137*a*, 140*a* are held locked by the associated first and second locking parts 180*a*, 180*b* within the through hole 180. Thus, the cam disc 177 is kept rotating together with the upper gear 133 in the normal direction. Therefore, the cam disc 177 can be prevented from rotating ahead of the upper gear 113 in the normal direction by inertial force produced during its normal rotation.

Further, if such a phenomenon that the cam disc 177 rotates ahead of the upper gear 113 in the normal direction is not caused due to change or modification of the product design or specifications, or more specifically, if a sufficient resistance is ensured between the cain disc 177 and the cam block 171, the flat surface 178*f* formed in the rear end region of the large-diameter region 178*b* may be omitted and the rear end region of the large-diameter region 178*b* may have a circular arc configuration.

As described above, in the battery-powered pin tucker 100 according to this embodiment, by provision of the lock avoiding mechanism comprising the support shaft 137*a* of the lift roller 137, the support shaft 140*a* of the cam 140 and the through hole 180 of the cam disc 177, the cam block 171 is allowed to smoothly move back into engagement with the small-diameter region 178*c* via the large-diameter region 178*b*. Thus, a smooth driving operation can be achieved. Particularly, the lock avoiding mechanism can be realized in a simple structure using the support shaft 137*a*, 140*a* and the through hole 180 which are engaged with each other.

OTHER EMBODIMENTS

The present invention is not limited to the above embodiment, but rather, may be added to, changed, replaced with alternatives or otherwise modified. For example, the following provisions can be made in application of this embodiment.

In the above embodiment, the lock avoiding mechanism described as being formed by the support shafts 137*a*, 140*a* and the through hole 180 which are engaged with each other. However, the construction of the lock avoiding mechanism can be appropriately changed as necessary. For example, a construction as shown in FIGS. 16 to 18 may be used FIGS, 16 to 18 show the construction and operation of a lock avoiding mechanism according to another embodiment.

Figure 16:
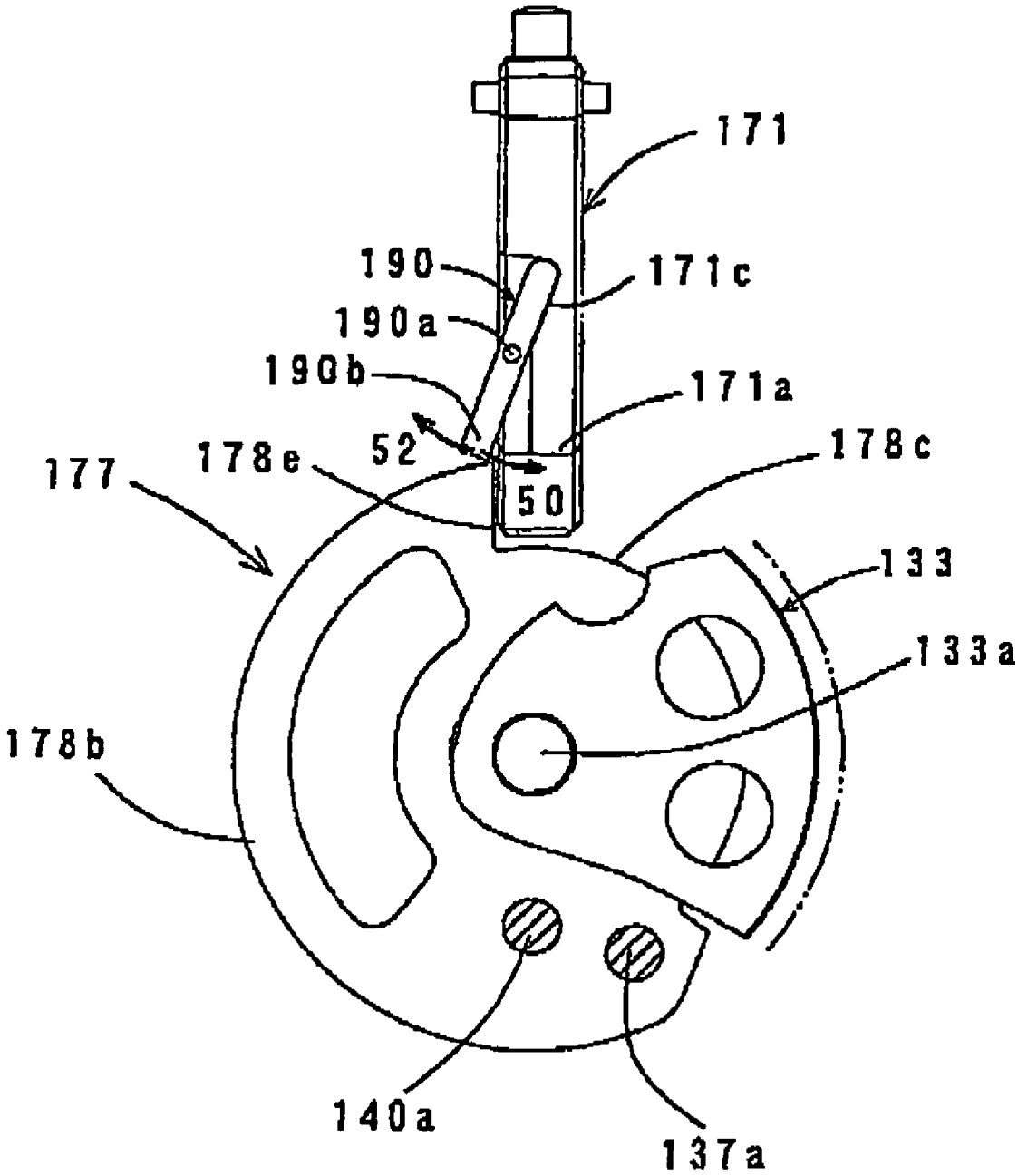
FIG. 16 shows the construction and operation of a lock avoiding mechanism according to another embodiment.
Figure 17:
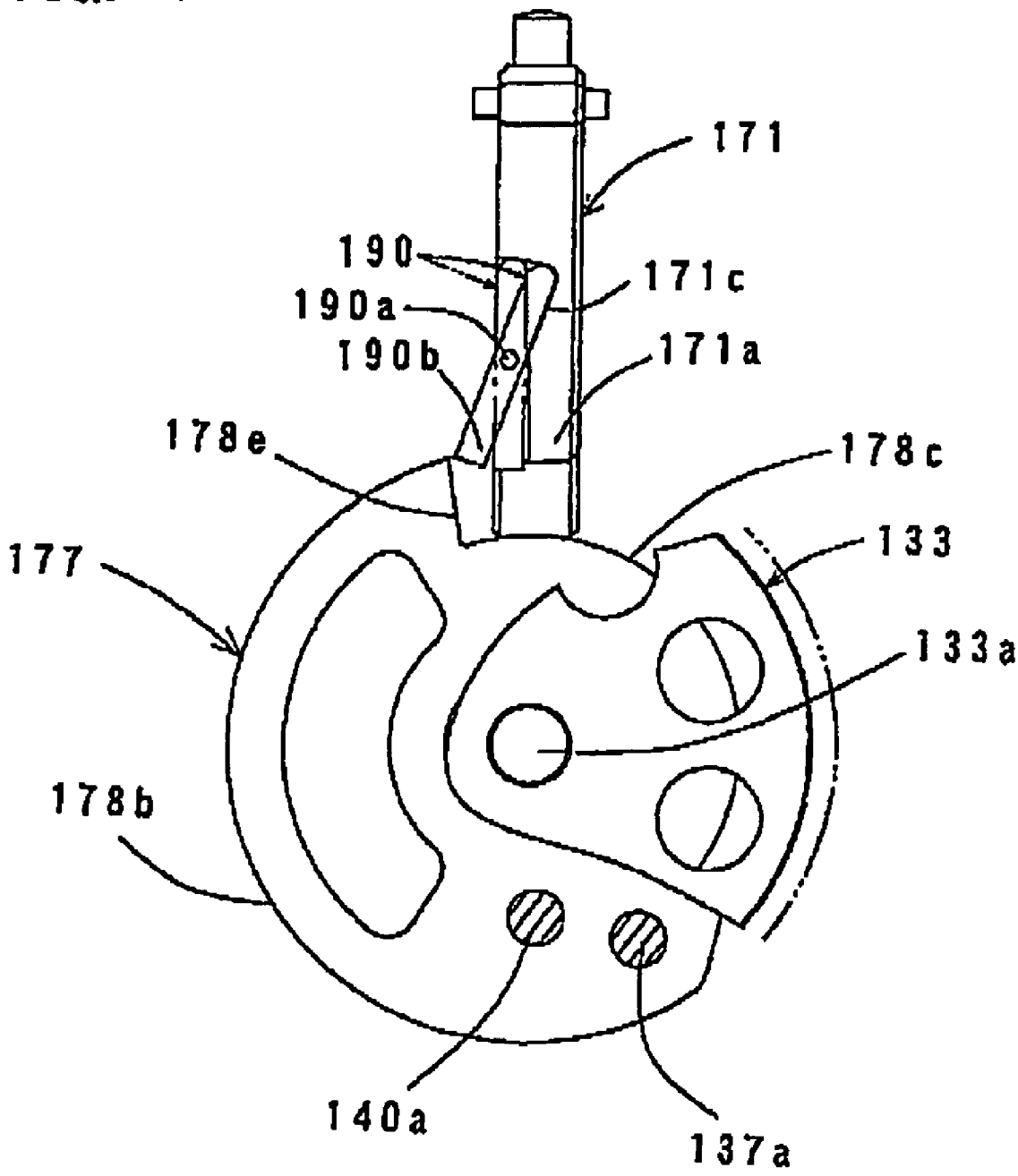
FIG. 17 shows the construction and operation of the lock avoiding mechanism according to the embodiment.
Figure 18:
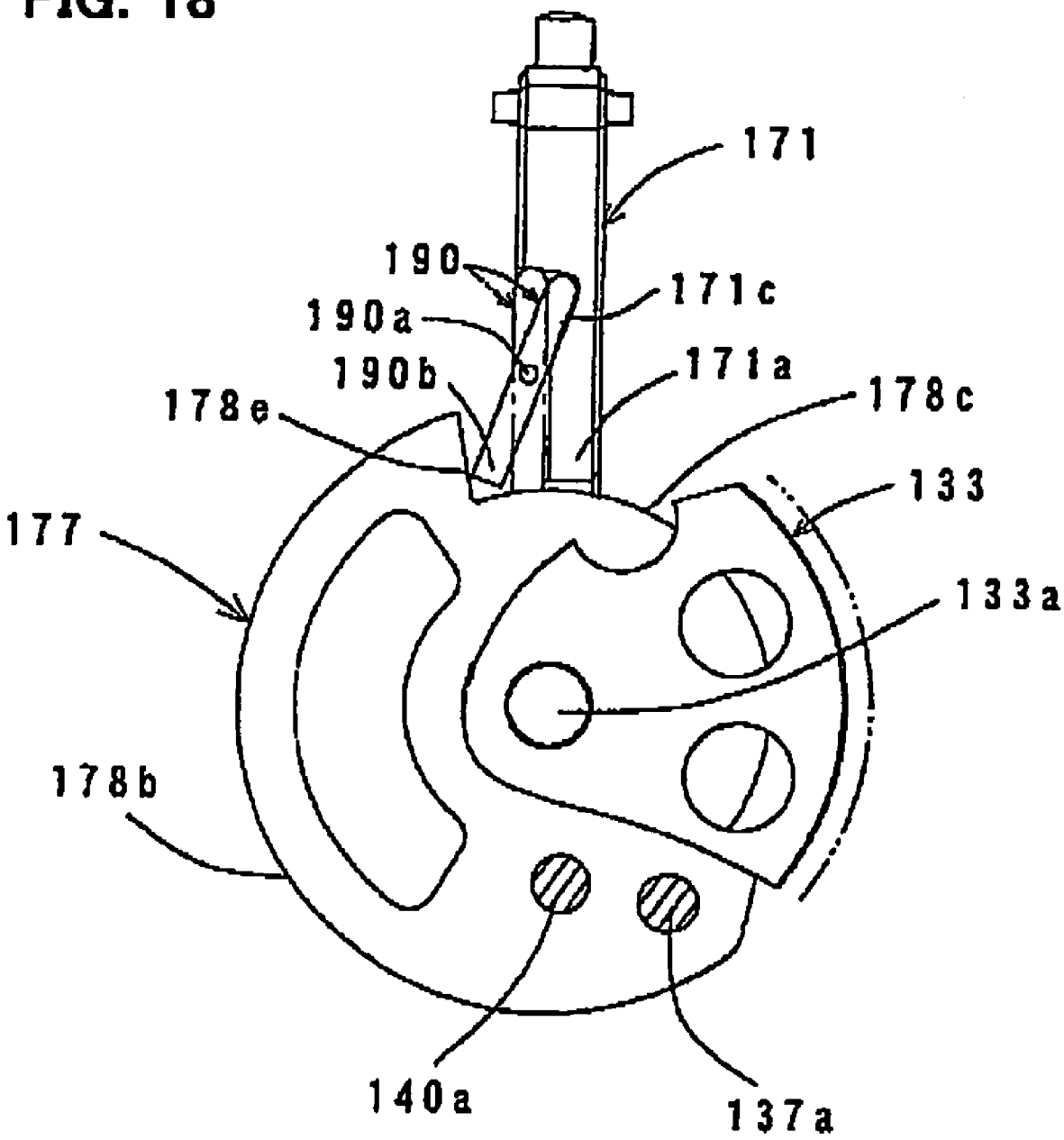
FIG. 18 shows the construction and operation of the lock avoiding men according to the embodiment.

In the lock avoiding mechanism of the embodiment shown in FIGS. 16 to 18, the upper gear 133 and the cam disc 177 always rotate together on the same axis (the axis 133*a*). The lock avoiding mechanism of this embodiment uses a pivot arm 190 provided on the rear end side (left side as viewed in FIG. 16) of the cam block 171. The pivot arm 190 is allowed to rotate on a rotating shaft 190*a* on the cam block 171 side in the direction of an arrow 50 and in the direction of an arrow 52 in FIG. 16. With this construction, during normal rotation of the cam disc 177, while the contact portion 171*a* of the cam block 171 is sliding on the large-diameter region 178*b* of the cam disc 177, the pivot arm 190 rotates in the direction of the arrow 52 in FIG. 16 by friction between an arm end 190*b* and the cam disc 177 and is held in contact with a stopper surface 171*c*, and the arm end 190*b* slides on the large-diameter region 178*b*.

Further, when the cam disc 177 further rotates in the normal direction from the state shown in FIG. 16, the contact between the end 190*b* of the pivot arm 190 and the large-diameter region 178*b* is released. The pivot arm 190 is then located in a position shown by a solid line or a phantom line in FIG. 17 and the cam block 171 is allowed to move downward toward the small-diameter region 178*c* without being locked by the second vertical wall 178*e*. At this time, when the pivot arm 190 is located, for example, in the position shown by the solid line in FIG. 17, the pivot arm 190 is allowed to rotate in the direction of the arrow 50 in FIG. 16 against a load from the second vertical wall 178*e*. As a result it is made possible to avoid the cam block 171 from being locked to the second vertical wall 178*e* by the spring force of the compression coil spring 127 being transmitted to the cam block 171 via the second vertical wall 178*e*. Thus, the cam block 171 is prevented from being locked against movement in engagement with the second vertical wall 178*e*, so that the cam block 171 is allowed to smoothly move downward to the small-diameter region 178*c*. Thus, the state shown in FIG. 18 can be achieved in the positional relationship of the cam block 171 to the cam disc 177.

Further, the configuration of the end 190*b* of the pivot arm 190, or more specifically, the configuration of the portion of the pivot arm 190 which contacts the cam disc 177 can be an appropriately selected configuration, such as an inclined surface or a curved surface, which is designed to create a moment in the direction of an arrow 52 in FIG. 16 on the pivot arm 190 by the pressing force of the cam block 171. Further, the configuration designed to create a moment in the direction of the arrow 52 in FIG. 16 on the pivot arm 190 may be provided on the cam disc 177 side.

Further, in the above embodiment, the battery-powered pin tucker is described as a representative example of a driving power tool. However, this invention is not limited to the battery-powered pin tucker, but can be applied to an AC-powered or air driven pin tucker or a battery-powered, AC-powered or air-driven nailing machine.

DESCRIPTION OF NUMERALS

100 battery-powered pin tucker
101 body
103 motor housing
105 gear housing
105*a* first contact wall
105*b* second contact wall
106 clearance
107 handgrip
109 battery case
111 magazine
112 injection part
112*a* pin injection port
113 driving motor
115 speed reducing mechanism
115*a* output shaft
115*b* driving gear
116 ratchet wheel
116*a* engagement groove
116*b* vertical wall
116*c* inclined wall
117 driving mechanism
118 leaf spring
118*a* engagement claw
118*b* first contact piece
118*c* second contact piece
119 hammer drive mechanism
121 slide guide
123 slider
125 Janet
125*a* upper engagement projection
125*b* lower engagement projection
126 stopper
127 compression coil spring
129 driver
131 connecting pin
133 upper gear
133*a* shaft
134 frame
135 lower gear
135*a* shaft
137 upper lift roller
137*a* support shaft
139 lower lift roller
139*a* support shaft
140 cam
140*a* support shaft
141 trigger
141 trigger
143 safety lever
145 light
147 light illuminating switch
148 first switch
160 operating device
161 internal switch
163 trigger switch
171 cam block
171*a* contact portion
171*b* engagement portion
171*c* stopper surface
172 switch arm
172*a* shaft
173 second switch
177 cam disc
178 cam face
178*a* rake region
178*b* large-diameter region
178*c* small-diameter region
178*d* first vertical wall
178*e* second vertical wall
178*f* flat surface
179 clearance
180 through hole
180*a* first locking part
180*b* second locking part
190 pivot arm
190*a* rotating shaft
190*b* end

I claim:

1. A driving power tool for driving a driving material into a workpiece, comprising:

a coil spring that builds up a spring force, an operating member that is mounted on the end of the coil spring and linearly operates by free extension of the coil spring having the built-up spring force and thereby applies a driving force to the driving material, a drive member that drives the coil spring and thereby builds up the spring force on the coil spring, a rotating element that rotates in a normal direction against the spring force of the coil spring as the drive member drives the coil spring, an outer edge of the rotating element, including (i) a first outer edge portion extending along at least a portion of the circumferential direction of the rotating element, the first extending edge extending at a first distance from the center of rotation of the rotating element, and (ii) a second outer edge portion extending contiguously to the first outer edge portion along the circumferential direction of the rotating element, the second outer edge extending at a second distance shorter than the first distance, a first vertical wall formed at the circumferential direction of the rotating element, the first vertical wall formed between a front end region of the first outer edge portion and a rear end region of the second outer edge portion so as to at least partially transition the circumferential direction of the rotating element from the first outer edge portion to the second outer edge portion, a second vertical wall formed at the circumferential direction of the rotating element, the second vertical wall formed between a rear end region of the first outer edge portion and a front end region of the second outer edge portion, in the normal direction of rotation of the rotating element, so as to at least partially transition the circumferential direction of the rotating element from the first outer edge portion to the second outer edge portion, an engaging member that moves outward in the radial direction of the rotating element toward the first outer edge portion, the engaging member at least partially transitioning from the second outer edge to the first outer edge at the first vertical wall, the engaging member able to slide alone the first outer edge portion and thereafter moves inward in the radial direction of the rotating element and at least partially transition toward the second outer edge portion at the second vertical wall, the engaging member then returning back to the state of engagement with the second outer edge portion, as the rotating element rotates in the normal direction when the coil spring is driven by the drive member, whereby the engaging member defines a working stroke of the driving operation, a lock avoiding mechanism that avoids the engaging member from being locked to the second vertical wall by the spring force of the coil spring being transmitted to the engaging member via the second vertical wall in the process in which the engaging member moves inward in the radial direction of the rotating element toward the second outer edge portion the second vertical wall, a gear that is connected to the rotating element via the lock avoiding mechanism and inputs driving torque to the lock avoiding mechanism as the coil spring is driven by the drive member, wherein the lock avoiding mechanism allows relative rotation between the gear and the rotating element and includes an engagement pin provided on one of the gear and the rotating element, an engagement groove provided on the other of the gear and the rotating element and extending in an elongated manner along the direction of relative rotation between the gear and the rotating element to vary the position of the relative rotation between the gear and the rotating element, and a locking part to lock the engagement pin within the engagement groove.

2. The driving power tool as defined in claim 1, wherein, when the drive member is driven, the driving torque of the gear is transmitted to the rotating element via the engagement pin locked by the locking part, and the rotating element rotates together with the gear in the normal direction, while, when the drive member is stopped, the transmission of the driving torque of the gear to the rotating element is stopped and the locking of the engagement pin by the locking part is released, whereby the engagement pin is allowed to move within the engagement groove.

3. The driving power tool as defined in claim 2, wherein:

the rotating element has a surface formed and configured in a circular arc portion in the rear end region of the first outer edge portion such that the distance from the center of rotation of the rotating element to said surface gradually increases with respect to the reverse direction of rotation of the rotating element, and the surface converts a pressing force acting upon said surface into a force of rotation of the rotating element in the reverse direction, thereby holding the engagement pin locked by the locking part such that the rotating element is kept rotating together with the gear in the normal direction.

4. The driving power tool as defined in claim 1, wherein the lock avoiding mechanism comprises a pivot arm rotatably provided in an end region of the engaging member to face the rotating element such that the arm swings to project in the normal direction from the end region of the engaging member.

5. The driving power tool as defined in claim 1, wherein the power tool is defined as a nailing machine or a tucker.

* * * * *